US008387725B2

(12) United States Patent
Swadi et al.

(10) Patent No.: US 8,387,725 B2
(45) Date of Patent: Mar. 5, 2013

(54) PERCUSSION DRILLING ASSEMBLY AND HAMMER BIT WITH GAGE AND OUTER ROW REINFORCEMENT

(75) Inventors: Shantanu Swadi, Cypress, TX (US); Angelo Spedale, Cypress, TX (US); Charles Dewey, Houston, TX (US); Alan J. Marshall, Lost Creek, WV (US)

(73) Assignee: Smith International, Inc., Houston, TX (US)

( * ) Notice: Subject to any disclaimer, the term of this patent is extended or adjusted under 35 U.S.C. 154(b) by 0 days.

(21) Appl. No.: 12/102,324

(22) Filed: Apr. 14, 2008

(65) Prior Publication Data

US 2009/0255735 A1 Oct. 15, 2009

(51) Int. Cl.
*E21B 10/36* (2006.01)

(52) U.S. Cl. ..... 175/420.1

(58) Field of Classification Search ..... 175/414, 175/296, 293, 405, 420.1; 76/108.1, 108.2, 76/108.4

See application file for complete search history.

(56) References Cited

U.S. PATENT DOCUMENTS 5,065,827 A 11/1991 Meyers et al.
5,113,954 A * 5/1992 Hayashi et al. ..... 175/415
6,105,693 A * 8/2000 Ingmarsson ..... 175/414
6,293,357 B1 * 9/2001 Patterson ..... 175/93
6,848,521 B2 * 2/2005 Lockstedt et al. ..... 175/431
2006/0096788 A1 * 5/2006 Virtanen ..... 175/406
2006/0249309 A1 * 11/2006 Cruz ..... 175/57
2007/0240905 A1 * 10/2007 Mensa-Wilmot ..... 175/57
2008/0087473 A1 * 4/2008 Hall et al. ..... 175/414
2008/0156539 A1 * 7/2008 Ziegenfuss ..... 175/296

OTHER PUBLICATIONS

Declaration of Shantanu Swadi; dated Aug. 2, 2010 (3 pages).

* cited by examiner

*Primary Examiner* — David Andrews
*Assistant Examiner* — Kipp Wallace
(74) *Attorney, Agent, or Firm* — Osha Liang LLP

(57) ABSTRACT

A hammer bit for drilling a borehole in earthen formations comprises a bit body having a bit axis and a bit face. The bit face includes an inner region extending from the bit axis to about 50% of the bit radius and an outer region extending from the inner region to the outermost radius. In addition, the bit comprises a plurality of gage cutter elements mounted to the bit face in a circumferential gage row in the outer region. Further, the bit comprises a plurality of adjacent to gage cutter elements mounted to the bit face in a circumferential adjacent to gage row in the outer region. The cutting profile of at least one cutter element in each row in the outer region radially overlaps with the cutting profile of at least one other cutter element in a different row in rotated profile view.

46 Claims, 11 Drawing Sheets

PERCUSSION DRILLING ASSEMBLY AND HAMMER BIT WITH GAGE AND OUTER ROW REINFORCEMENT

CROSS-REFERENCE TO RELATED APPLICATIONS

Not applicable.

STATEMENT REGARDING FEDERALLY SPONSORED RESEARCH OR DEVELOPMENT

Not applicable.

BACKGROUND

1. Field of Art

The disclosure relates generally to earth boring bits used to drill a borehole for applications including the recovery of oil, gas or minerals, mining, blast holes, water wells and construction projects. More particularly, the disclosure relates to percussion hammer drill bits.

2. Background of Related Art

In percussion or hammer drilling operations, a drill bit mounted to the lower end of a drill string simultaneously rotates and impacts the earth in a cyclic fashion to crush, break, and loosen formation material. In such operations, the mechanism for penetrating the earthen formation is of an impacting nature, rather than shearing. The impacting and rotating hammer bit engages the earthen formation and proceeds to form a borehole along a predetermined path toward a target zone. The borehole created will have a diameter generally equal to the diameter or "gage" of the drill bit.

A typical percussion drilling assembly is connected to the lower end of a rotatable drill string and includes a downhole piston-cylinder assembly coupled to the hammer bit. The impact force is generated by the downhole piston-cylinder assembly and transferred to the hammer bit via a driver sub. To promote efficient penetration by the hammer bit, the bit is "indexed" to fresh earthen formations for each subsequent impact. Indexing is achieved by rotating the hammer bit a slight amount between each impact of the bit with the earth. The simultaneous rotation and impacting of the hammer bit is accomplished by rotating the drill string and incorporating longitudinal splines which key the hammer bit body to a cylindrical sleeve (commonly known as the driver sub or chuck) at the bottom of the percussion drilling assembly. The hammer bit is rotated through engagement of a series of splines on the bit and driver sub that allow axial sliding between the components but do not allow significant rotational displacement between the hammer assembly and bit. As a result, the drill string rotation is transferred to the hammer bit itself. Rotary motion of the drill string may be powered by a rotary table typically mounted on the rig platform or top drive head mounted on the derrick.

Without indexing, the cutting structure extending from the lower face of the hammer bit may have a tendency to undesirably impact the same portion of the earth as the previous impact. Experience has demonstrated that for an eight inch hammer bit, a rotational speed of approximately 20 rpm and an impact frequency of 1600 bpm (beats per minute) typically result in relatively efficient drilling operations. This rotational speed translates to an angular displacement of approximately 5 to 10 degrees per impact of the bit against the rock formation.

The hammer bit body may be generally described as cylindrical in shape and includes a radially outer skirt surface aligned with or slightly recessed from the borehole sidewall and a bottomhole facing cutting face. The earth disintegrating action of the hammer bit is enhanced by providing a plurality of cutting elements that extend from the cutting face of the bit for engaging and breaking up the formation. The cutting elements are typically inserts formed of a superhard or ultrahard material, such as polycrystalline diamond (PCD) coated tungsten carbide and sintered tungsten carbide, that are press fit into undersized apertures in bit face. During drilling operations with the hammer bit, the borehole is formed as the impact and indexing of the drill bit, and thus cutting elements, break off chips of formation material which are continuously cleared from the bit path by pressurized air pumped downwardly through ports in the face of the bit.

In oil and gas drilling, the cost of drilling a borehole is very high, and is proportional to the length of time it takes to drill to the desired depth and location. The time required to drill the well, in turn, is greatly affected by the number of times the drill bit must be changed before reaching the targeted formation. This is the case because each time the bit is changed, the entire string of drill pipe, which may be miles long, must be retrieved from the borehole, section by section. Once the drill string has been retrieved and the new bit installed, the bit must be lowered to the bottom of the borehole on the drill string, which again must be constructed section by section. As is thus obvious, this process, known as a "trip" of the drill string, requires considerable time, effort and expense. Accordingly, it is always desirable to employ drill bits which will drill faster and longer, and which are usable over a wider range of formation hardness.

The length of time that a drill bit may be employed before it must be changed depends upon its rate of penetration ("ROP"), as well as its durability. The form and positioning of the cutting elements upon the bit face greatly impact hammer bit durability and ROP, and thus are critical to the success of a particular bit design.

To assist in maintaining the gage of a borehole, conventional hammer bits typically employ a gage row of hard metal inserts along the gage surface of the cutting face. The gage surface generally represents the radially outermost portion of the bit face, and is configured and positioned to cut the corner of the borehole as the hammer bit impacts the formation. In this position, the gage cutting elements are generally required to cut both a portion of the borehole bottom and sidewall. The lower surface of the gage cutting elements engages the borehole bottom, while the radially outermost surface scrapes the sidewall of the borehole. Excessive wear of the gage cutting elements can lead to an undergage borehole, decreased ROP, increased loading on the other cutting elements on the bit, and may ultimately lead to bit failure.

Moving radially inward from the gage row, conventional hammer bits also typically include an "adjacent to gage" row. Cutting elements in the adjacent to gage row are mounted radially inside the gage row and are orientated and sized in such a manner so as to cut the borehole bottom. In addition, conventional bits typically include a number of additional rows of cutting elements that are located on the bit face radially inward from the adjacent to gage row. These cutting elements are sized and configured for cutting the bottom of the borehole and are typically described as inner row cutting elements and, as used herein, may be described as bottomhole cutting elements.

As previously described, during drilling operations, the hammer bit impacts the formation and indexes in a cyclical fashion. As the hammer bit rotates, the cutting elements extending from the bit face slide across the borehole bottom. Since gage cutting elements are the radially outermost cutting elements on the bit face, they experience greater linear velocities and travel (slide) across a greater distance of the borehole bottom when the hammer bit is indexed as compared to other cutting elements on the bit face. Due to the combination of impacting the borehole bottom, scraping the borehole sidewall, and sliding across the borehole bottom during indexing, gage cutting elements are typically the most susceptible to premature damage and failure as compared to the other cutting elements on the hammer bit.

Increasing ROP while simultaneously increasing the service life of the drill bit will decrease drilling time and allow valuable oil and gas to be recovered more economically. Accordingly, cutting element orientation and placement along the cutting face of a hammer bit that enable increased ROP and longer bit life would be particularly desirable.

SUMMARY OF SOME OF THE PREFERRED EMBODIMENTS

These and other needs in the art are addressed in one embodiment by a hammer bit for drilling a borehole in earthen formations. In an embodiment, the hammer bit comprises a bit body having a bit axis and a bit face with an outermost radius. The bit face includes an inner region extending from the bit axis to about 50% of the bit radius and an outer region extending from the inner region to the outermost radius. In addition, the hammer bit comprises a plurality of gage cutter elements mounted to the bit face in a circumferential gage row in the outer region, each gage cutter element having substantially the same radial position relative to the bit axis. Further, the hammer bit comprises a plurality of adjacent to gage cutter elements mounted to the bit face in a circumferential adjacent to gage row in the outer region, each adjacent to gage cutter element having substantially the same radial position relative to the bit axis. Still further, the hammer bit comprises a plurality of inner row cutter elements mounted in a plurality of circumferential rows in the inner region and the outer region. Each inner row cutter element is radially positioned between the bit axis and the adjacent to gage cutter elements. Moreover, each cutter element has a cutting portion extending from the bit face, the cutting portion defining a cutting profile in rotated profile view. The cutting profile of at least one cutter element in each row in the outer region radially overlaps with the cutting profile of at least one other cutter element in a different row in rotated profile view.

These and other needs in the art are addressed in another embodiment by a percussion drilling assembly for drilling a borehole in an earthen formation. In an embodiment, the drilling assembly comprises a case, a top sub coupled to the upper end of the case, a driver sub coupled to the lower end of the case, and a piston disposed within the case. In addition, the drilling assembly comprises a hammer bit slidingly received by the driver sub. The hammer bit includes a bit body having a bit axis and a bit face with an outermost radius. Further, the hammer bit includes a plurality of gage cutter elements mounted to the bit face in a circumferential gage row in the outer region, each gage cutter element having substantially the same radial position relative to the bit axis. Still further, the hammer bit includes a plurality of adjacent to gage cutter elements mounted to the bit face in a circumferential row in the outer region that is radially adjacent the gage row, each gage cutter element having substantially the same radial position relative to the bit axis. Each cutter element has a cutting portion extending from the bit face, the cutting portion defining a cutting profile in rotated profile view. Moreover, the cutting profile of each gage cutter element extends radially from an inner radius measured perpendicularly from the bit axis to an outer radius measured perpendicularly from the bit axis, wherein the cutting profile of each adjacent to gage cutter element extends radially from an inner radius measured perpendicularly from the bit axis to an outer radius measured perpendicularly from the bit axis, and wherein the inner radius of the cutting profile of each gage cutter element is less than the outer radius of the cutting profile of each adjacent to gage cutter element. The radial distance between the inner radius of the cutting profile n of each adjacent to gage cutter element and the outer radius of the cutting profile of each gage cutter element defines a radial span distance, and the radial distance between the inner radius of the cutting profile of each gage cutter element and the outer radius of the cutting profile of each adjacent to gage cutter element defines a radial overlap distance. The ratio of the radial overlap distance to the radial span distance is between 0.10 and 0.50.

These and other needs in the art are addressed in another embodiment by a hammer bit for drilling a borehole in earthen formations. In an embodiment, the hammer bit comprises a bit body having a bit axis and a bit face with an outermost radius. In addition, the hammer bit comprises a plurality of gage cutter elements mounted to the bit face in a circumferential gage row, each gage cutter element having substantially the same radial position relative to the bit axis. Further, the hammer bit comprises a plurality of adjacent to gage cutter elements mounted to the bit face in a circumferential row that is radially adjacent the gage row, each gage cutter element having substantially the same radial position relative to the bit axis. Still further, the hammer bit comprises a first plurality of inner row cutter elements mounted in a first inner row that is radially adjacent the adjacent to gage row, each of the first plurality of inner row cutter elements having substantially the same radial position relative to the bit axis. Moreover, the hammer bit comprises a second plurality of inner row cutter elements mounted in a second inner row that is radially adjacent the first inner row, each of the second plurality of inner row cutter elements having substantially the same radial position relative to the bit axis. Each cutter element has a cutting portion extending from the bit face, the cutting portion defining a cutting profile in rotated profile view. The cutting profile of each gage cutter element radially overlaps with the cutting profile of each adjacent to gage cutter element in rotated profile view. The cutting profile of each adjacent to gage cutter element radially overlaps with the cutting profile each of the first plurality of inner row cutter elements in rotated profile view. The cutting profile of each of the first plurality of inner row cutter elements radially overlaps with the cutting profile of each of the second plurality of inner row cutter elements in rotated profile view. Each of the gage cutter elements, adjacent to gage cutter elements, first plurality of inner row cutter elements, and second plurality of inner row cutter elements is a PCD cutter element.

These and other needs in the art are addressed in another embodiment by a hammer bit for drilling a borehole in earthen formations. In an embodiment, the hammer bit comprises a bit body having a bit axis and a bit face. In addition, the hammer bit comprises a plurality of gage cutter elements mounted to the bit face in a circumferential gage row, each gage cutter element having substantially the same radial position relative to the bit axis. Further, the hammer bit comprises a skirt surface extending from the periphery of the bit face. Still further, the hammer bit comprises a first plurality of gage protection cutter elements extending from the skirt surface. The first plurality of gage cutter elements are arranged in a first circumferential row. Moreover, the hammer bit comprises a second plurality of gage protection cutter elements extending from the skirt surface, wherein the second plurality of gage protection cutter elements are arranged in a second circumferential row axially spaced from the first circumferential row.

These and other needs in the art are addressed in another embodiment by a hammer bit for drilling a borehole in earthen formations. In an embodiment, the hammer bit comprises a bit body having a bit axis and a bit face. The bit face includes a radially outermost frustoconical gage. In addition, the hammer bit comprises a plurality of gage cutter elements extending from the gage surface, wherein each gage cutter element has substantially the same radial position relative to the bit axis. Further, the hammer bit comprises a plurality of adjacent to gage cutter elements extending from the gage surface. Each adjacent to gage cutter element has substantially the same radial position relative to the bit axis and is positioned radially inward of each gage cutter element relative to the bit axis. Each cutter element has a cutting portion extending from the bit face, the cutting portion defining a cutting profile in rotated profile view. Moreover, the cutting profile of at least one gage cutter element radially overlaps with the cutting profile of at least one adjacent to gage cutter element in rotated profile view.

Thus, embodiments described herein comprise a combination of features and advantages intended to address various shortcomings associated with certain prior devices. The various characteristics described above, as well as other features, will be readily apparent to those skilled in the art upon reading the following detailed description of the preferred embodiments, and by referring to the accompanying drawings.

BRIEF DESCRIPTION OF THE DRAWINGS

For a detailed description of the disclosed embodiments, reference will now be made to the accompanying drawings in which.

DETAILED DESCRIPTION OF THE DISCLOSED EMBODIMENTS

Figure 1:
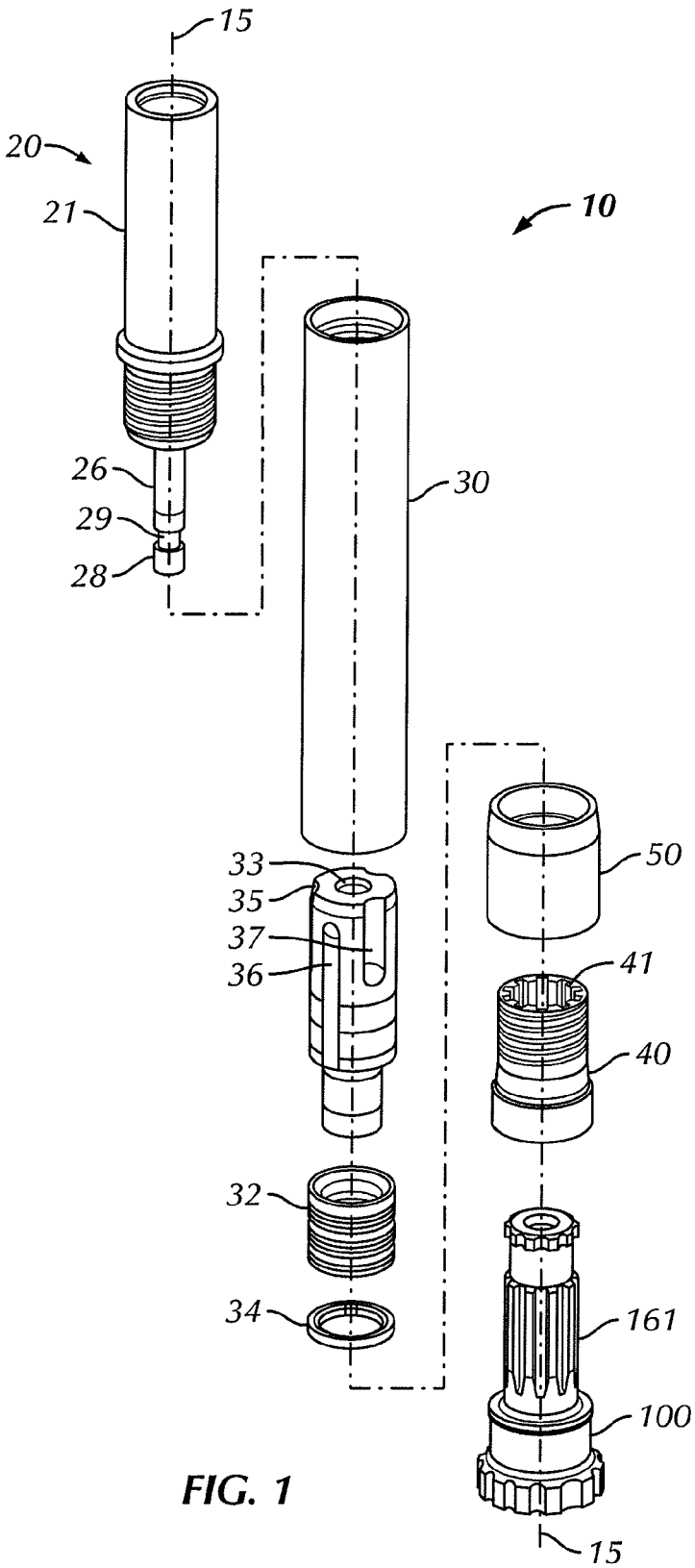
FIG. 1 is an exploded perspective view of a percussion drilling assembly including an embodiment of a hammer bit made in accordance with the principles described herein.

The following discussion is directed to various exemplary embodiments of the invention. Although one or more of these embodiments may be preferred, the embodiments disclosed should not be interpreted, or otherwise used, as limiting the scope of the disclosure, including the claims. In addition, one skilled in the art will understand that the following description has broad application, and the discussion of any embodiment is meant only to be exemplary of that embodiment, and not intended to suggest that the scope of the disclosure, including the claims, is limited to that embodiment.

Certain terms are used throughout the following description and claims to refer to particular features or components. As one skilled in the art will appreciate, different persons may refer to the same feature or component by different names. This document does not intend to distinguish between components or features that differ in name but not function. The drawing figures are not necessarily to scale. Certain features and components herein may be shown exaggerated in scale or in somewhat schematic form and some details of conventional elements may not be shown in interest of clarity and conciseness.

In the following discussion and in the claims, the terms "including" and "comprising" are used in an open-ended fashion, and thus should be interpreted to mean "including, but not limited to . . . ." Also, the term "couple" or "couples" is intended to mean either an indirect or direct connection. Thus, if a first device couples to a second device, that connection may be through a direct connection, or through an indirect connection via other devices and connections. Further, the terms "axial" and "axially" generally mean along or parallel to a central or longitudinal axis, while the terms "radial" and "radially" generally mean perpendicular to a central longitudinal axis.

Figure 2:
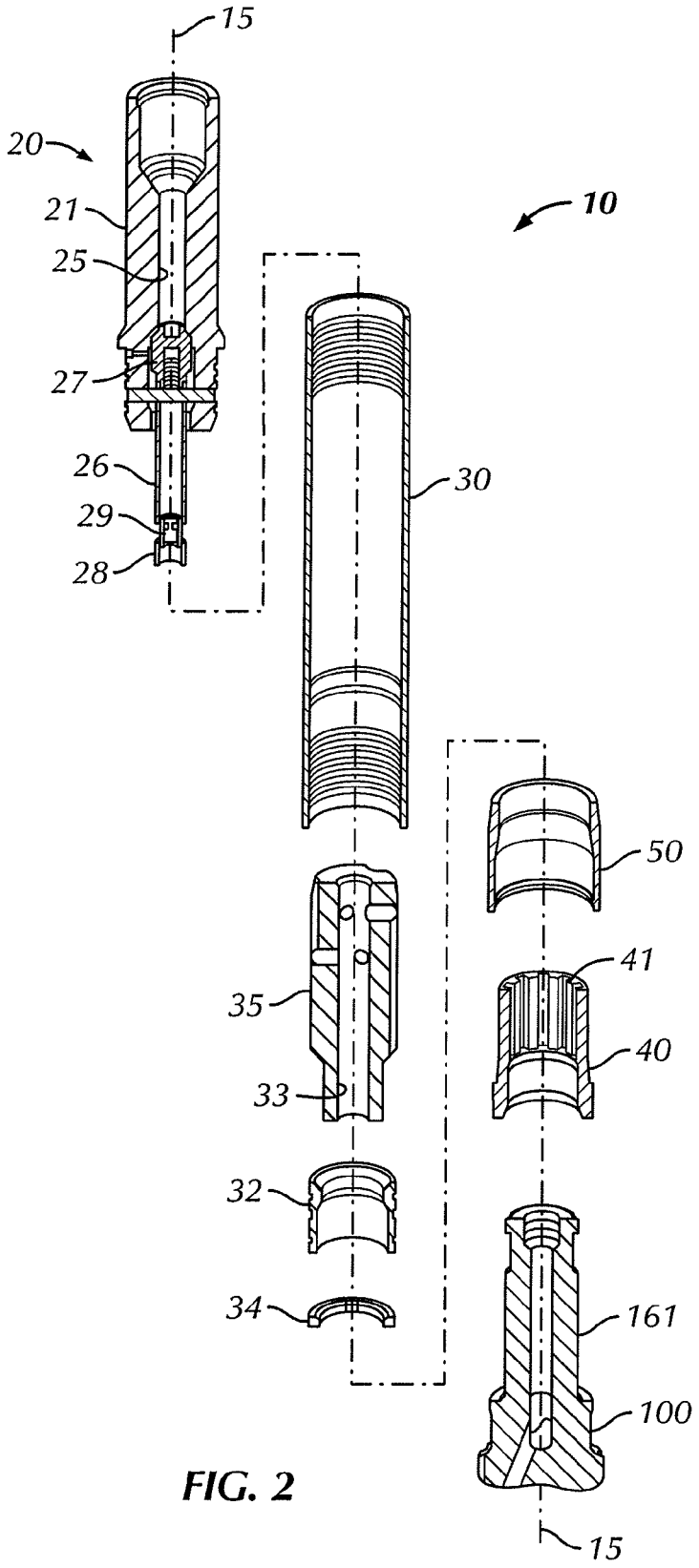
FIG. 2 is an exploded, cross-sectional view of the percussion drilling assembly of FIG. 1.
Figure 3:
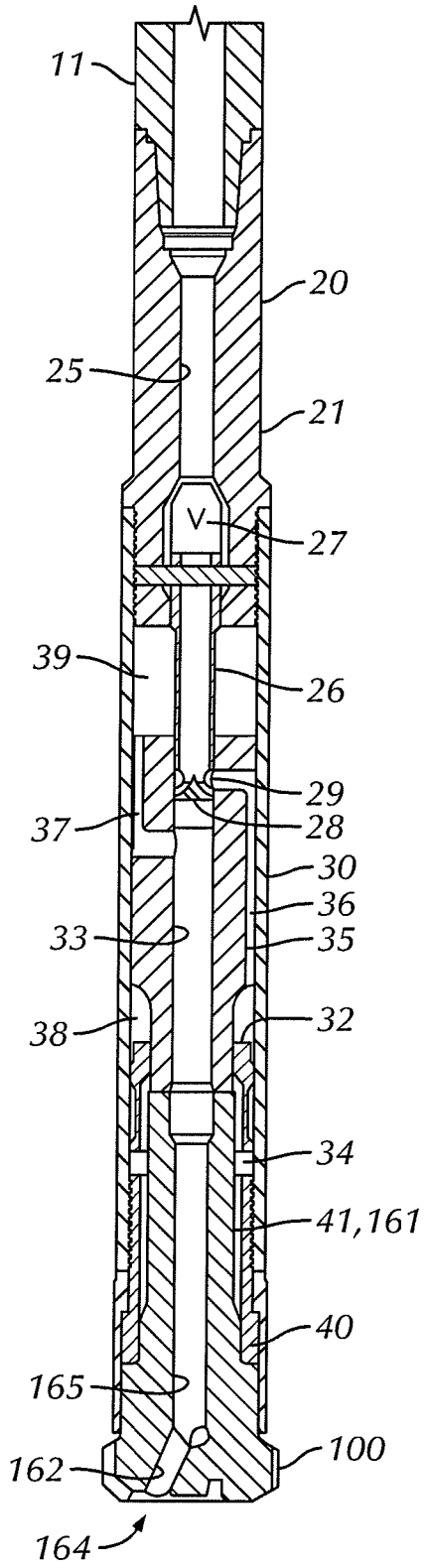
FIG. 3 is a cross-sectional view of the percussion drilling assembly of FIG. 1 connected to the lower end of a drillstring.

Referring now to FIGS. 1-3, an embodiment of a percussion drilling assembly 10 adapted for drilling through formations of rock to form a borehole is shown. Assembly 10 is connected to the lower end of a drillstring 11 (FIG. 3) and comprises a top sub 20, a driver sub 40, a tubular case 30 axially disposed between top sub 20 and driver sub 40, a piston 35 disposed in the tubular case 30, and a hammer bit 100 slidingly received by driver sub 40. Top sub 20, case 30, piston 35, driver sub 40, and hammer bit 100 are generally coaxially aligned, each sharing a common central or longitudinal axis 15.

Top sub 20 includes a body 21 having a central through bore 25 and a feed tube 26 extending axially from the bottom of body 21 into case 30. The upper end of body 21 is threadingly coupled to the lower end of drillstring 11 (FIG. 3), and the lower end up top sub 20 is threadingly coupled to the upper end of case 30.

Central through bore 25 is in fluid communication with drillstring 11. A check valve 27 disposed in bore 25 at the upper end of feed tube 26 allows one-way fluid communication between bore 25 and feed tube 26. In particular, check valve 27 allows fluid to flow downward through drillstring 11 and bore 25 into feed tube 26, but restricts backflow from feed tube 26 into bore 25 and drillstring 11. In this manner, check valve 27 serves to restrict and/or prevent the back flow of cuttings from the wellbore into drillstring 11. In some embodiments, a choke may also be provided in conjunction with check valve 27 to regulate fluid flow rates and/or downstream pressures.

The lower end of feed tube 26 includes a stopper 28 having circumferentially spaced radial ports 29 and a choke 28. A portion of the fluid flowing axially down feed tube 26 flows radially outward through ports 29, and a portion flows through choke 28 into a through bore 33 in piston 35.

Referring still to FIGS. 1-3, the lower end of case 30 is threadingly coupled to the upper end of driver sub 40. Piston 35 is slidingly disposed in case 30 above hammer bit 100 and cyclically impacts hammer bit 100 as will be described in more detail below. The central through bore 33 in piston 35 slidingly receives the lower end of feed tube 26, a first set of flow passages 36 in fluid communication bore 33, and a second set of flow passages 37 in fluid communication with bore 33. Flow passages 36 are in fluid communication with a lower chamber 38 defined by case 30 and the lower end of piston 35, while flow passages 37 are in fluid communication with an upper chamber 39 defined by case 30 and the upper end of piston 35. As will be explained in more detail below, during drilling operations, piston 35 is cyclically actuated within case 30 by alternating the flow of the pressurized fluid (e.g., pressurized air) between flow ports 36, 37 and chambers 38, 39, respectively.

A guide sleeve 32 and a bit retainer ring 34 are also positioned in case 30 above driver sub 40. Guide sleeve 32 slidingly receives the lower end of piston 35. Bit retainer ring 34 is disposed about the upper end of hammer bit 100 and prevents hammer bit 100 from completely disengaging assembly 10.

Hammer bit 100 slideably engages driver sub 40. A series of generally axial mating splines 161, 41 on bit 100 and driver sub 40, respectively, allow bit 100 to move axially relative to driver sub 40 while simultaneously allowing driver sub 40 to rotate bit 100 with drillstring 11 and case 30. A retainer sleeve 50 is coupled to driver sub 40 and extends along the outer periphery of hammer bit 100. As described in U.S. Pat. No. 5,065,827, which is hereby incorporated herein by reference in its entirety, the retainer sleeve 50 generally provides a secondary catch mechanism that allows the lower enlarged head of hammer bit 100 to be extracted from the wellbore in the event of a breakage of the enlarged bit head.

In addition, hammer bit 100 includes a central longitudinal bore 165 in fluid communication with downwardly extending passages 162 having ports or nozzles 164 formed in the face of hammer bit 100. Bore 165 is also in fluid communication with bore 33 of piston 35. Guide sleeve 32 maintains fluid communication between bores 33, 165 as piston 35 moves axially upward relative to hammer bit 100. Pressurized fluid exhausted from chambers 38, 39 into main bore 33 of piston 45 flows through bore 165, passages 162 and out ports or nozzles 164. Together, passages 162 and nozzles 164 serve to distribute pressurized fluid around the face of bit 100 to flush away formation cuttings during drilling and to remove heat from bit 100.

Referring still to FIGS. 1-3, during drilling operations, a pressurized fluid (e.g., pressurized air) flows down the drill string 11, through bore 25, check valve 27, and feed tube 26 to ports 29. A portion of the pressurized fluid flows through choke 28, bore 33, bore 165, through downward passages 162, and exits hammer bit 100 via ports 164. The other portion of the pressurized fluid is directed to ports 29 and functions to cyclically actuate piston 35. More specifically, piston 35 is axially actuated between a lowermost or first position shown in FIG. 3 (lower end of piston 35 engages the upper end of hammer bit 100) and an uppermost or second position by alternating the flow of the pressurized fluid between flow ports 36, 37 and chambers 38, 39, respectively. In particular, when piston 35 is in the first position, feed tube 26 and radial ports 29 are in fluid communication with flow passages 36 and lower chamber 38, while flow passages 37 and upper chamber 39 are in fluid communication with bores 33, 165. Thus, the pressurized fluid flows through ports 29 and flow passages 36 to lower chamber 38. Pressure in lower chamber 38 increases until it is sufficient to move piston 35 axially upward. As piston 35 moves axially upward within case 30, the volume of upper chamber 39 decreases and the pressure in upper chamber 39 increases. However, the fluid in upper chamber 39 is exhausted through flow passages 37, bores 33, 165, downward passages 162, and exits hammer bit 100 via ports 164. As piston 35 moves axially upward, ports 29 eventually move out of alignment with flow passages 36, and thus, pressurized fluid is not longer provided to lower chamber 38. At about the same time, ports 29 move into alignment with flow passages 37, and the lower end of piston 35 is disposed axially above the upper end of guide sleeve 32. The flow of the pressurized fluid through ports 29 and flow passages 37 into upper chamber 39 serves to retard the upward travel of piston 35. Piston 35 achieves the second position at the point it ceases its upward movement.

When piston 35 is in the second position, the pressurized fluid flows through ports 29 and flow passages 37 to upper chamber 39. Pressure in upper chamber 39 increases until it is sufficient to move piston 35 axially downward. As piston 35 moves axially downward within case 30, the volume of lower chamber 38 decreases and the pressure in lower chamber 38 increases. However, since the lower end of piston 35 is disposed above guide sleeve 32, the fluid in lower chamber 38 is directly exhausted to bore 165, through downward passages 162, and exits hammer bit 100 via ports 164. As piston 35 moves axially downward, ports 29 eventually move out of alignment with flow passages 37, and thus, pressurized fluid is not longer provided to upper chamber 39. Shortly thereafter, the lower end of piston 35 impacts the upper end of hammer bit 100, and ports 29 move into alignment with flow passages 36, marking the transition of piston 35 to its lower most or second position. The described cycle repeats to deliver repetitive high energy blows to hammer bit 100.

It should also be appreciated that during drilling operations, drill string 11 and drilling assembly 10 are rotated. Mating splines 161, 41 on bit 100 and driver sub 40, respectively, allow bit 100 to move axially relative to driver sub 40 while simultaneously allowing driver sub 40 to rotate bit 100 with drillstring 11. The rotation of hammer bit 100 allows the cutting elements (not shown) of bit 100 to be "indexed" to fresh rock formations during each impact of bit 100, thereby improving the efficiency of the drilling operation.

Figure 4:
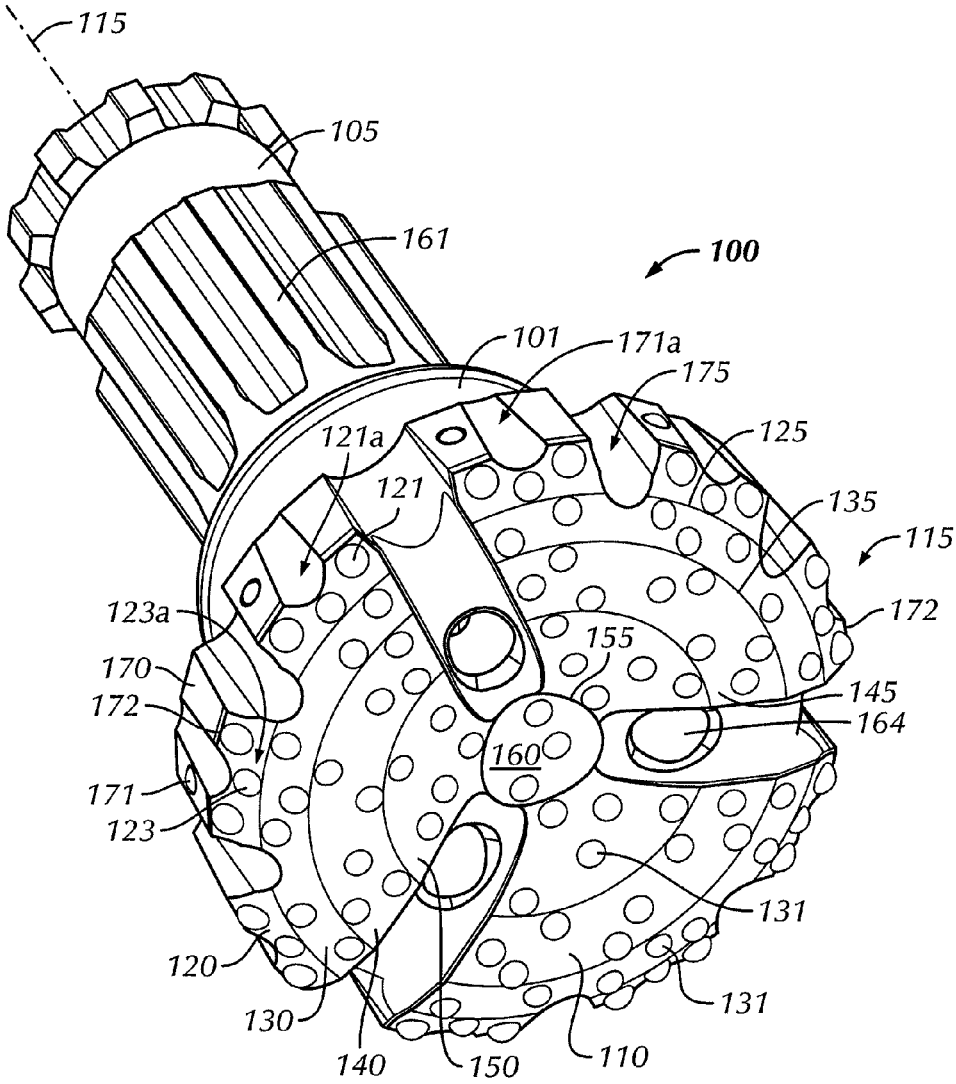
FIG. 4 is a perspective view of the hammer bit of FIG. 1.
Figure 5:
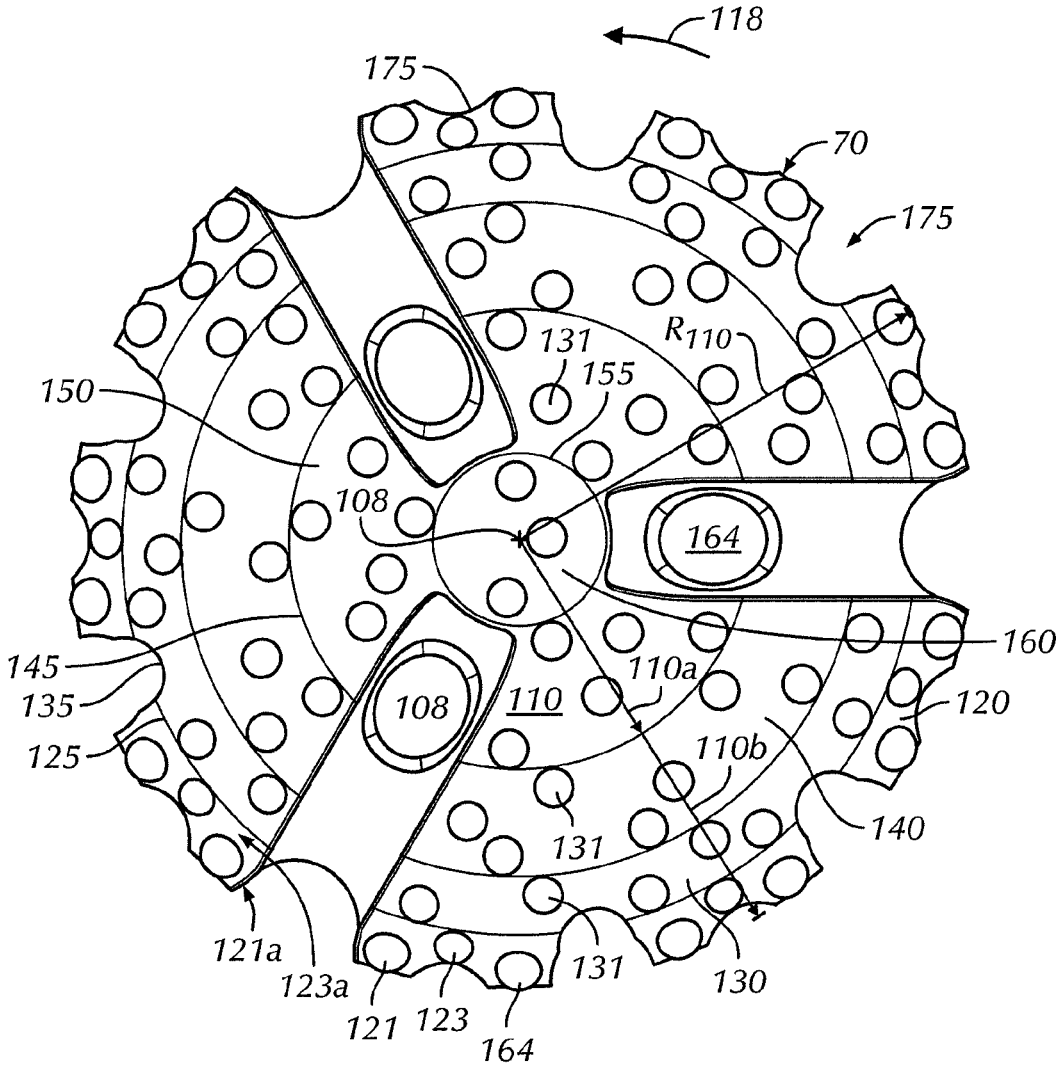
FIG. 5 is a bottom view of the hammer bit of FIG. 1.

Referring now to FIGS. 4 and 5, hammer bit 100, sometimes referred to as a percussion bit, and is preferably a PD bit adapted for drilling through formations of rock to form a borehole. Bit 100 generally includes a bit body 101 and a shank 105 including a plurality of axially aligned splines 161 for connecting bit 100 to a percussion drilling assembly (e.g., assembly 10). Formation engaging bit face 110 is formed on the end of the bit 100 that is opposite shank 105 and supports a cutting structure 115. Bit 100 further includes a central axis 108 about which bit 100 is indexed in the direction represented by arrow 118. The body may be machined from a metal block, such as steel. As used herein, the terms "axial" and "axially" may be used to refer to positions or movement measured generally parallel to the bit axis (e.g., axis 108), and the terms "radial" and "radially" may be used to refer to positions or movement measured generally perpendicular to the bit axis.

As best shown in FIG. 3, central longitudinal bore 165 permits pressurized drilling fluids (e.g., compressed air, air-mist system, nitrogen or other compatible gas-liquid media) to flow through the drill string into bit 100. Downwardly extending flow passages 162 in fluid communication with central bore 165 flow the pressurized fluid to ports or nozzles 164 in bit face 110. Together, flow passages 162 and nozzles 164 serve to distribute the drilling fluids around cutting structure 115 to flush away formation cuttings during drilling and to remove heat from bit 100.

Figure 6:
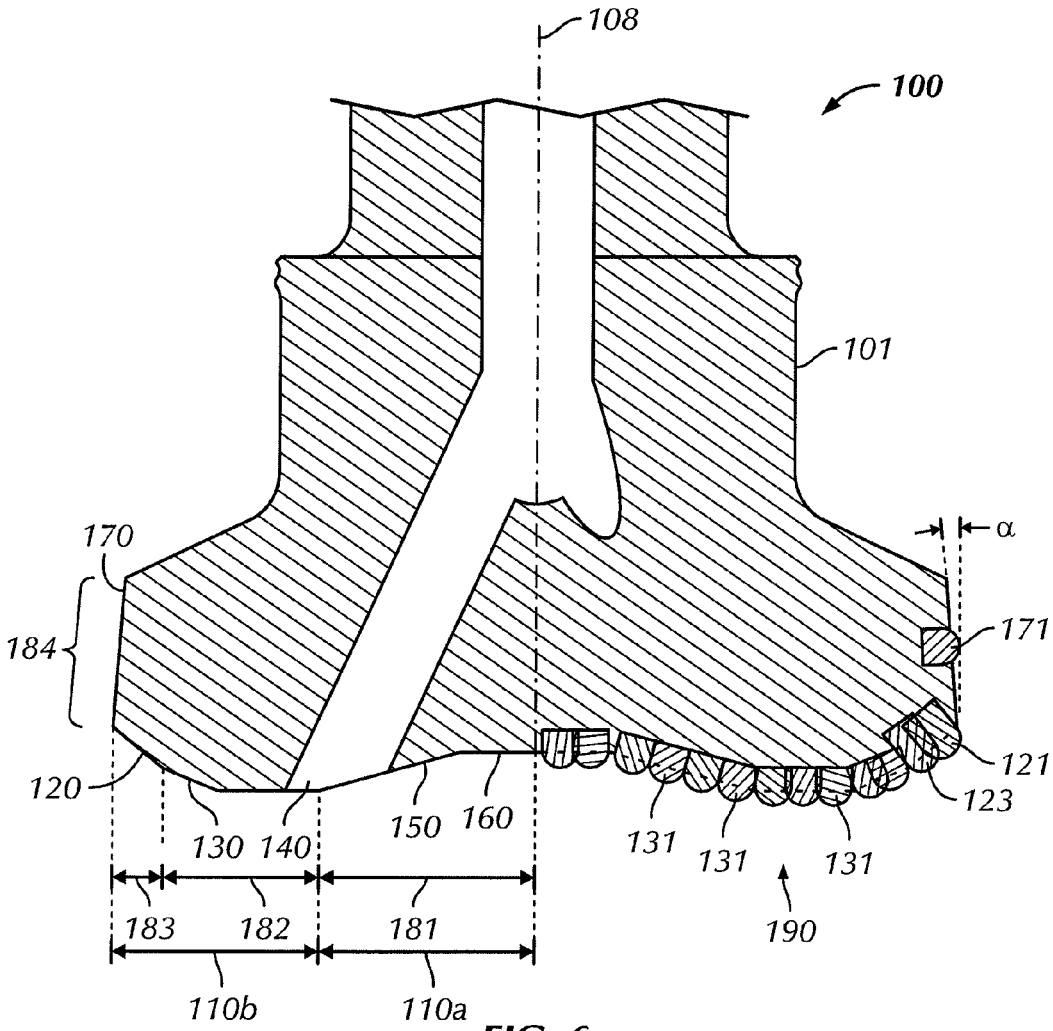
FIG. 6 is a rotated profile view of the hammer bit of FIG. 1 with the cutting face, skirt surface, and cutter elements rotated into a single profile.

Referring now to FIGS. 4-6, bit face 110 includes a radially innermost generally planar central surface 160 and a radially outermost generally frustoconical annular gage surface 120. Central surface 160 is generally perpendicular to bit axis 108. Moving radially inward from gage surface 120, bit face 110 includes an annular, generally frustoconical first inner surface 130, an annular, generally planar second inner surface 140, and an annular, generally frustoconical third inner surface 150. Surfaces 120, 130 converge in a circumferential edge 125, surfaces 130, 140 converge in a circumferential edge 135, surfaces 140, 150, converge in a circumferential edge 145, and surfaces 150, 160 converge in a circumferential edge 155. Although referred to herein as an "edge," it should be understood that each shoulder 125, 135, 145, 155 may be contoured, such as by a radius.

As best shown in FIGS. 5 and 6, bit 100 and bit face 110 define an outer radius $R_{110}$. Bit face 110 may be divided into an inner region 110*a* extending from bit axis 108 to about 50% of radius $R_{110}$ and an outer region 110*b* extending from inner region 110*a* to radius $R_{110}$.

In this embodiment, central surface 160 preferably extends from bit axis 108 to about 10% to 20% of radius $R_{110}$, third inner surface 150 preferably extends from central surface 160 to about 40% to 50% of bit radius $R_{110}$, second inner surface 140 preferably extends from third inner surface 150 to about 70% to 80% of bit radius $R_{110}$, first inner surface 130 extends from second inner surface 140 to about 75% to 90% of bit radius $R_{110}$, and gage surface 120 extends from first inner surface 130 to bit radius $R_{110}$. Thus, in this embodiment, inner region 110*a* includes central surface 160 and third inner surface 150, and outer region 110*b* includes second inner surface 140, first inner surface 130, and gage surface 120. Although this embodiment is described as including five distinct surfaces 120, 130, 140, 150, 160, in other embodiments, the bit face (e.g., bit face 110) may include fewer or more distinct surfaces between the bit axis and the periphery of the bit.

Referring still to FIGS. 4-6, cutting structure 115 includes a plurality of wear resistant inserts or cutter elements disposed about face 110 and arranged in circumferential rows in the embodiment shown. More specifically, bit 100 includes a radially outermost circumferential gage row 121*a* of gage cutter elements or inserts 121 secured to gage surface 120. Radially adjacent gage row 121*a*, bit 100 includes a second circumferential row 123*a* of adjacent to gage cutter elements or inserts 123 secured to gage surface 120. Thus, gage inserts 121 and adjacent to gage inserts 123 both extend from gage surface 120. In other words, in this embodiment, both gage inserts 121 and adjacent to gage inserts 123 extend from the same frustoconical surface (i.e., gage surface 120). Radially inward of gage row 121*a* and adjacent to gage row 123*a*, bit 100 includes inner row cutter elements or inserts 131 arranged in a plurality of circumferential inner rows on surfaces 130, 140, 150, 160.

Gage inserts 121 function primarily to cut the corner of the borehole. In other words, gage inserts 121 cut a portion of the borehole bottom and a portion of the borehole sidewall. As such, cutter elements 121 maintain the gage of the borehole, and thus, are crucial to the formation of the borehole. Adjacent to gage inserts 123 also function to cut the corner of the borehole, but cut a greater proportion of the borehole bottom as compared to gage inserts 121. As will be described in more detail below, adjacent to gage inserts 123 load share with gage inserts 121, thereby offering the potential to reduce wear of gage inserts 121, thereby increasing the durability and life of gage inserts 121. Inner row inserts 131 are employed to gouge and remove formation material from the remainder of the borehole bottom. As best shown in FIG. 6, cutter elements 121, 123, 131 are positioned to maximize borehole bottom coverage. To enhance the durability and life of bit 100, gage cutter elements 121 and adjacent to gage cutter elements 123 are preferably PCD (polycrystalline diamond) cutter elements, and more preferably, all cutter elements 121, 123, 131 are PCD cutter elements.

Referring still to FIGS. 4-6, bit body 101 further includes a radially outer skirt surface 170 that converges with bit face 110 at a circumferential edge or shoulder 172. In this embodiment, shoulder 172 is beveled, however, in other embodiments, shoulder 172 may be radiused or curved. Skirt surface 170 extends generally upward from the outer periphery of bit face 110. In this embodiment, skirt surface 170 is generally frustoconical and is tapers towards bit axis 108 moving axially upward from face 110. Consequently, skirt surface 170 is canted away from the borehole sidewall. As best shown in FIG. 6, skirt surface 170 is canted at an angle $\alpha$ relative to the borehole sidewall. Angle $\alpha$ is preferably between 0 and 20°, and more preferably between 0 and 10°. In this embodiment, angle $\alpha$ is about 5°. In other embodiments, the skirt surface (e.g., skirt surface 170) is substantially parallel with the bit axis (e.g., bit axis 108). A plurality of axial slots or scallops 175 are circumferentially spaced about skirt surface 170. During drilling operations, slots 175 provide a path between skirt surface 170 and the borehole sidewall through which pressurized fluid exiting nozzles 164 may flow.

In this embodiment, a plurality of gage protection cutter elements 171 are positioned in a circumferential row 171*a* about skirt surface 170. Cutter elements 171 generally function to scrape or ream the borehole sidewall to maintain the borehole at full gage and load share with gage cutter elements 121. Thus, gage protection cutter elements 171 offer the potential to reduce impact loads, stresses, and wear experienced by gage cutter elements 121, thereby enabling longer service lives for gage cutter elements 121.

In the embodiment shown, inserts 121, 123, 131, 171 each include a generally cylindrical base portion, a central axis, and a cutting portion that extends from the base portion, and further includes a cutting surface for cutting the formation material. The base portion is secured by interference fit into a mating socket drilled into the bit face. In general, the cutting surface of an insert refers to the surface of the insert that extends beyond the surface of the bit face. In this embodiment, each cutter element 121, 123, 131, 171 is a semi-round top (SRT) insert having a generally semi-spherical or dome shaped cutting surface. In other embodiments, one or more of the cutter elements (e.g., cutter elements 121, 123, 131, 171) may comprise alternative shapes and profiles including, without limitation, conical shaped and chisel shaped.

In the embodiments shown, cutter elements 121, 123, 131, 171 are oriented substantially perpendicular to surface from which they extend, and further, radially positioned within the boundaries of each surface from which they extend. For instance, gage cutter elements 121 extend perpendicularly from gage surface 120 and are positioned between edge 125 and shoulder 172. It should be appreciated that cutter elements disposed in the same circumferential row are positioned at substantially the same radial distance from axis 108, and thus, may be described has having the same radial position.

Referring now to FIG. 6, in rotated profile view, surfaces 120, 130, 140, 150, 160, 170 form a combined or composite bit profile 180 (left side of bit 100 in FIG. 6), and cutter elements 121, 123, 131, 171 form a combined or composite cutting profile 190 (right side of bit 100 in FIG. 6). As used herein, the phrase "cutting profile" may be used to refer to the profile of the cutting portion of one or more inserts (i.e., the profile of the portion of one or more inserts that extends from the bit face and engages the formation). It should be appreciated that cutter elements 121, 123, 131, 171 within a given circumferential row are disposed at substantially the same radial position relative to bit axis 108, and thus, completely overlap in rotated profile view.

Composite bit profile 180 may generally be divided into four regions conventionally labeled cone region 181, shoulder region 182, gage region 183, and skirt region 184. Cone region 181 comprises the radially innermost region of bit face 110. In this embodiment, cone region 181 is generally concave and is defined by surfaces 150, 160. Adjacent cone region 181 is shoulder region 182. In this embodiment, shoulder region 182 is generally convex and is defined by surfaces 130, 140. Moving radially outward, adjacent shoulder region 182 is the gage region 183, followed by skirt region 184. Gage region 183 is defined by gage surface 120, and skirt region 184 is defined by skirt surface 170.

Inner row inserts 131 are disposed in cone region 181 and shoulder region 182, gage inserts 121 and adjacent to gage inserts 123 are disposed in gage region 183, and gage protection inserts 171 are disposed in skirt region 184. As shown by cutting profile 190, cutter elements 121, 123, 131 cover substantially all of the borehole bottom.

Figure 7:
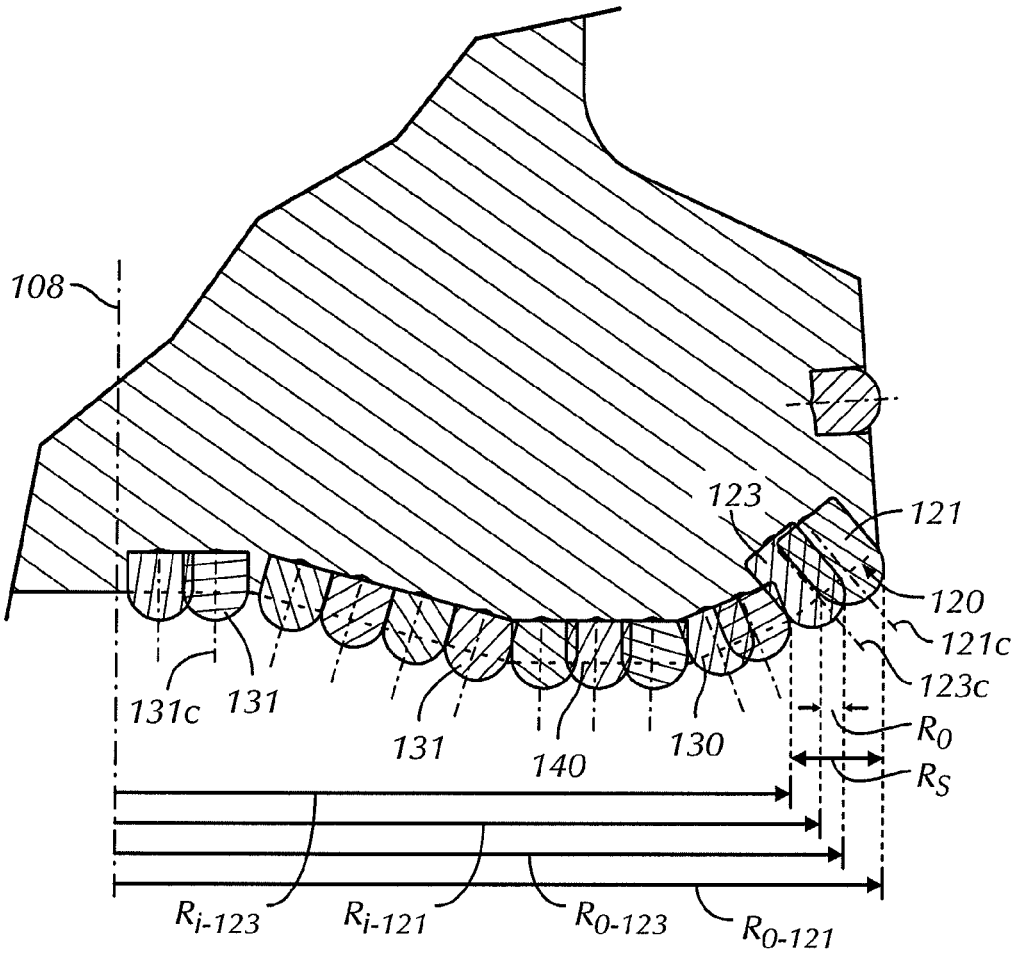
FIG. 7 is an enlarged partial view of the rotated profile of FIG. 6.

Referring now to FIG. 7, each gage insert 121 has a central axes 121*c*, each adjacent to gage insert 123 has central axis 123*c*, and each inner row insert 131 has a central axis 131*c*. As previously described, in this embodiment, inserts 121, 123, 131 are oriented substantially perpendicular to the surface from which they extend. Thus, axes 121*c*, 123*c* of inserts 121, 123 extending from gage surface 120 are substantially parallel, axes 131*c* of inserts 131 extending from surface 130 are substantially parallel, axes 131*c* of inserts 131 extending from surface 140 are substantially parallel, axes 131*c* of inserts 131 extending from surface 150 are substantially parallel, and axes 131*c* of inserts 131 extending from surface 160 are substantially parallel.

Referring still to FIG. 7, inserts 121, 123 extending from surface 120 in outer region 110*b* are positioned on bit face 110 such that the cutting profile of each insert 121 radially overlaps with the cutting profile of each insert 123. In addition, inserts 131 extending from surfaces 130, 140 in outer region 110*b* are positioned on bit face 110 such that the cutting profile of each insert 131 radially overlaps with the cutting profile of at least one other insert 131 in an adjacent row. Thus, the cutting profiles of a majority of cutter elements in each row disposed in outer region 110*b* radially overlap with the cutting profile of at least one other cutter element in outer region 110*b*. As used herein, the terms "overlap" and "overlapping" may be used to describe cutter elements or inserts in adjacent rows (i.e., at different radial positions) whose cutting profiles at least partially extend over or cover each other in rotated profile view. For example, the cutting profile of each adjacent to gage insert 123 (i.e., the portion of each adjacent to gage insert 123 extending from surface 120) extends radially from an inner radius $R_{i\text{-}123}$ to an outer radius $P_{o\text{-}123}$ with respect to bit axis 108. Further, the cutting profile of each gage insert 121 (i.e., the portion of each gage insert 121 extending from surface 120) extends radially from an inner radius $R_{i\text{-}121}$ to an outer radius $R_{o\text{-}121}$ with respect to bit axis 108. Inner radius $R_{i\text{-}121}$ of gage cutter elements 121 is less than outer radius $R_{o\text{-}123}$ of adjacent to gage cutter elements 123, and thus, the cutting profiles of cutter elements 121, 123 extending from surface 120 radially overlap.

The cutting profiles of overlapping cutter elements 121, 123 extend a combined radial span distance $R_s$, equal to the difference between outer radius $R_{o\text{-}121}$ and inner radius $R_{i\text{-}123}$. Accordingly, as used herein, the phrase "radial span distance" may be used to describe the radial distance, measured perpendicularly to the bit axis, spanned or covered by the cutting profiles of two adjacent overlapping cutter elements or inserts in rotated profile view. In addition, the cutting profiles of overlapping cutter elements 121, 123 overlap a radial overlap distance $R_o$ equal to the outer radius $R_{o\text{-}123}$ of adjacent to gage cutter elements 123 minus inner radius $R_{i\text{-}121}$ of gage cutter elements 121. Accordingly, as used herein, the phrase "radial overlap distance" may be used to describe the radial distance, measured perpendicularly to the bit axis, over which two adjacent cutting elements or inserts overlap.

In general, the degree of overlap of the cutting profiles of overlapping inserts in adjacent rows may be characterized by the ratio of the radial overlap distance (e.g., radial overlap distance $R_o$) to the radial span distance (e.g., radial span distance $R_s$). For overlapping gage row and adjacent to gage row inserts (e.g., inserts 121, 123) this ratio, also referred to herein as the "radial overlap ratio," is preferably between about 0.10 and 0.50, and more preferably between 0.25 and 0.45. In this exemplary embodiment, the cutting profiles of overlapping inserts 121, 123 have a radial overlap ratio of about 0.50. Further, for overlapping inner row inserts (e.g., inner row inserts 131) the radial overlap ratio is preferably between about 0.10 and 0.50, and more preferably between 0.25 and 0.45. In this exemplary embodiment, the cutting profiles of overlapping inserts 131 have a radial overlap ratio of about 0.50.

Figure 8:
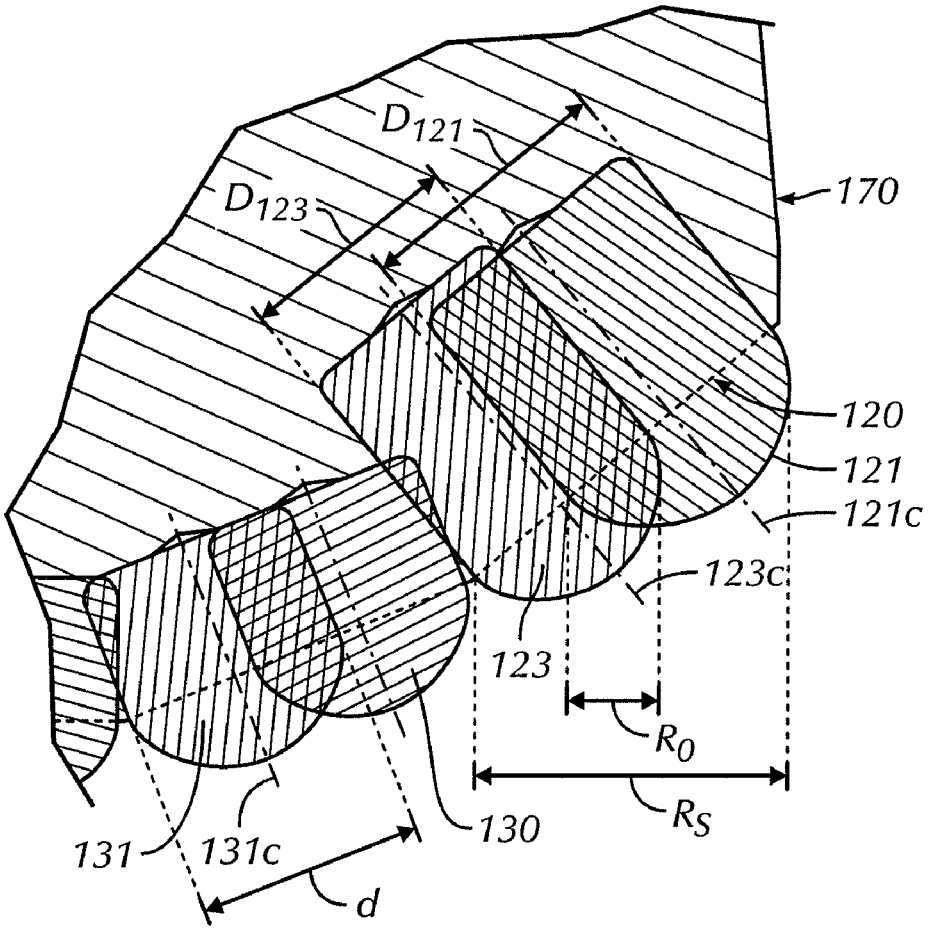
FIG. 8 is an enlarged partial view of gage and adjacent to gage inserts shown in the rotated profile of FIG. 7.

Referring now to FIG. 8, the degree of overlap of the cutting profiles of overlapping inserts in adjacent rows may be also be characterized by the ratio of the radial overlap distance (e.g., radial overlap distance $R_o$) to the average diameter of the overlapping inserts. For overlapping gage row and adjacent to gage row inserts (e.g., inserts 121, 123), the ratio of the radial overlap distance to the average diameter is preferably between about 0.10 and 0.60, and more preferably between 0.25 and 0.55. In this embodiment, inserts 121, 123 each have substantially the same diameter D, and thus, the average diameter of overlapping inserts 121, 123 is also diameter D. In this exemplary embodiment, the ratio of the radial overlap distance $R_o$ to the average diameter D is about 0.50. Further, for overlapping inner row inserts (e.g., inserts 131), the ratio of the radial overlap distance to the average diameter is preferably between about 0.10 and 0.60, and more preferably between 0.25 and 0.55.

In general, the gage cutter elements of a hammer bit function to cut a portion of the borehole bottom and a portion of the bore hole sidewall. Since most hammer bits are not designed to ream the borehole sidewall, maintenance of the full gage diameter of the borehole is primarily the responsibility of the gage cutter elements. Consequently, in most conventional hammer bits, wear and damage to the gage cutter elements detrimentally impacts the borehole diameter, which may periodically necessitate an undesirable step-down in bit diameter during extended drilling. Thus, maintenance and durability of the gage cutter elements is particularly important. In addition, as compared to radially inner inserts (e.g., inner row inserts 131 in central region 110*a*), the radially outer inserts (e.g., inserts 121, 123, 131 in radially outer region 110*b*), and particularly the gage inserts (e.g., gage inserts 121), are typically more susceptible to premature damage and wear during drilling operations since they travel or scrape across a greater distance of the borehole bottom as the hammer bit is indexed. Without being limited by this or any particular theory, the greater the radial distance between the bit axis (e.g., bit axis 108) and the insert, the greater the radial velocity and travel distance. Consequently, the radially outer inserts, and in particular, the gage inserts, tend to experience the most impact forces and abrasive wear. In some conventional hammer bits, additional numbers of gage inserts were provided in an attempt to deal with this problem in the gage region. However, simply increasing the number of gage inserts may detrimentally impact bit hydraulics. In particular, increasing the number of gage inserts may necessitate a reduction in the size of the slots or scallops provided in the skirt surface, thereby decreasing the flow area and path for the pressurize fluid to flush cuttings and remove heat from the hammer bit.

Embodiments described herein offer the potential to improve the durability of the radially outer inserts, and in particular, the gage inserts, and hence improve the durability of the entire bit. Without being limited by this or any particular theory, radially overlapping adjacent inserts (e.g., inserts 121, 123) allows for load sharing, thereby at least partially reducing loads on each of the overlapping inserts). For example, when adjacent to gage inserts 123 and gage inserts 121 are positioned such that they radially overlap in rotated profile view, adjacent to gage inserts 123 share axial loads with gage inserts 122 imparted as hammer bit 100 impacts the formation. More specifically, due to the overlap of inserts 121, 123, portions of adjacent to gage cutter elements 123 absorb axial loading that, in the absence of adjacent to gage inserts 123, would be entirely imparted to gage inserts 121. By distributing the axial loads across gage inserts 121 and adjacent to gage inserts 123, detrimental stresses in gage inserts 121 may be reduced.

Figure 9:
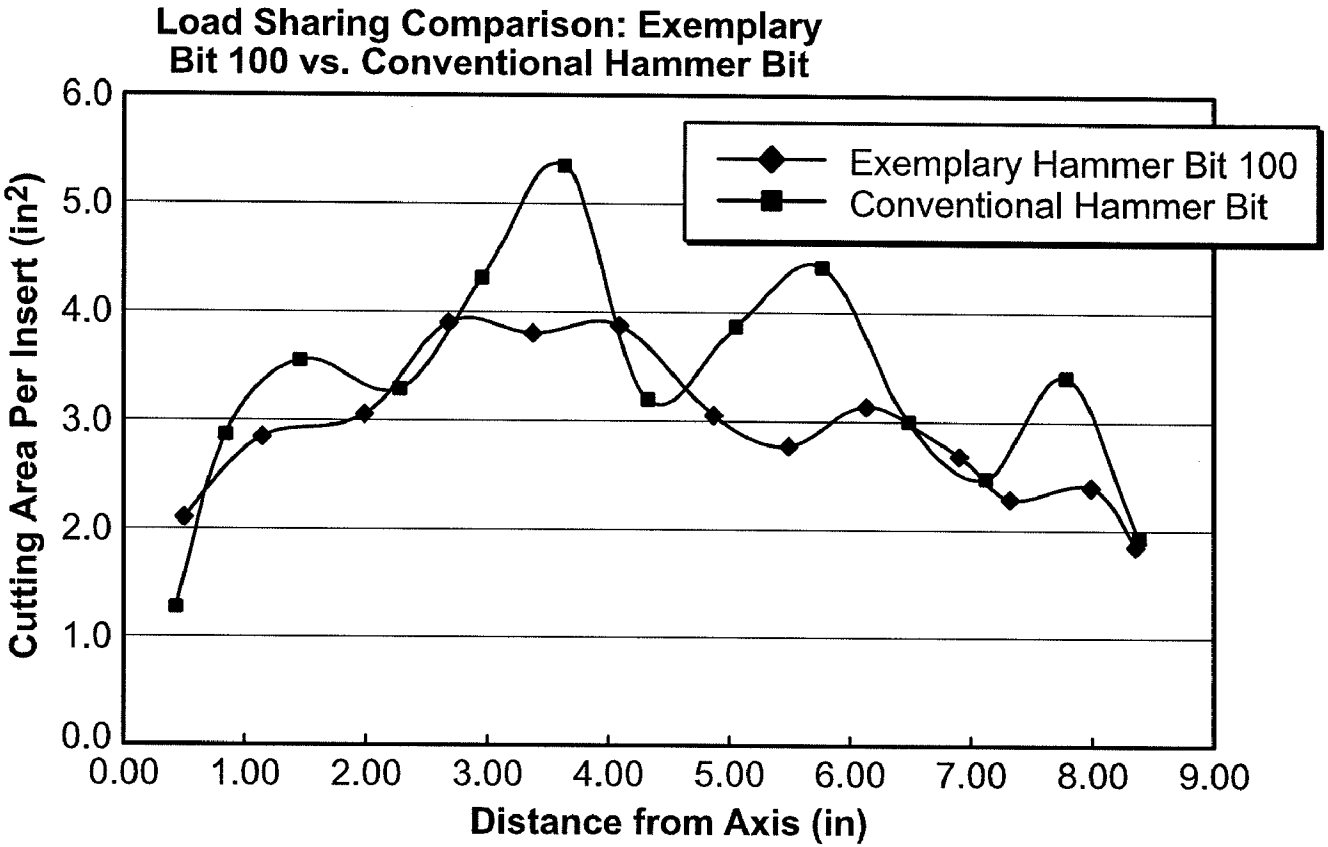
FIG. 9 is a graphical comparison of the average cutting area per insert of an exemplary bit made in accordance with the principles described herein to a similarly sized conventional hammer bit.

Referring now to FIG. 9, a graphical comparison of the load sharing of an exemplary bit 100 designed in accordance with the principles described herein and a conventional hammer bit is illustrated. For purposes of comparison, exemplary bit 100 and the conventional hammer bit each have a full gage diameter of 17.5 inches (i.e., a radius of 8.75 inches). As shown in FIG. 9, the average cutting area per insert at select radial distances from the bit axis is shown. Without being limited by this or any particular theory, the loads experienced by a given insert upon impact with the formation are directly related to the area of formation material impacted by the insert (i.e., cutting area of the insert). In other words, the greater the cutting area of an insert, the greater the loads experienced by the insert. Thus, the average cutting area per insert at a given radial distance is a general indicator of the average loads experienced by the insert.

For purposes of comparison in FIG. 9, the average cutting area of the non-overlapping inserts at each select radial position and the average cutting area of the radially overlapping inserts at each select radial position was calculated as follows. For the non-overlapping inserts in a circumferential row (i.e., inserts at substantially the same radial position that do not radially overlap with any other inserts), the average cutting area per insert is sum of the non-overlapping cutting areas of each insert in the row divided by the total number of inserts in the row. In general, the non-overlapping cutting area of an insert is the surface area of the portion of the cutting surface of the insert that does not radially overlap with any other insert. For a non-overlapping insert, the entire cutting area of the insert does not radially overlap with any other insert, and thus, the non-overlapping cutting area is the surface area of the entire cutting surface of the insert.

For the radially overlapping inserts in a circumferential row (i.e., inserts at substantially the same radial position that radially overlap with at least one other insert in rotated profile view), the average cutting area per insert is equal to the sum of (a) the average non-overlapping cutting area per insert in the row and (b) the average overlapping cutting area per insert in the row. The average non-overlapping cutting area per radially overlapping insert in a row is the sum of the non-overlapping cutting areas of each insert in the row divided by the total number of inserts in the row. The average overlapping cutting area per radially overlapping insert in a row is the total overlapping cutting area divided by the total number of overlapping inserts (i.e., inserts in the row and inserts in an adjacent and radially overlapping row). The total overlapping cutting area is the sum of (a) the overlapping cutting area of each insert in the row and (b) the overlapping cutting area of each insert in an adjacent but radially overlapping row (i.e., inserts at different radial positions). For example, referring briefly to FIG. 7, the average cutting area per gage insert 121 is the sum of (a) the average non-overlapping cutting area per gage insert 121 and (b) the average overlapping cutting area per gage insert 121. The average non-overlapping cutting area per gage insert 121 is the sum of the surface area of the cutting surface of each gage insert 121 radially disposed between radius $R_{o\text{-}123}$ and radius $R_{o\text{-}121}$, divided by the total number of gage inserts 121. The average overlapping cutting area per gage insert 121 is the total overlapping cutting area of gage inserts 121 and adjacent to gage inserts 123 divided by the total number of gage inserts 121 and adjacent to gage inserts 123. The total overlapping cutting area of gage inserts 121 is the sum of (a) the surface area of the cutting portion of each gage insert 121 radially disposed between radius $R_{i\text{-}121}$ and radius $R_{o\text{-}123}$, and (b) the surface area of the cutting portion of each adjacent to gage inserts 123 radially disposed between radius $R_{i\text{-}121}$ and radius $R_{o\text{-}123}$.

Referring still to FIG. 9, the average cutting area per insert for the conventional hammer bit ranges from about 1.0 inches$^2$ to over 5.0 inches$^2$. However, the average cutting area per insert for the exemplary hammer bit 100 designed according to the principles described herein is generally between about 2.0 inches$^2$ to 4.0 inches$^2$. Further, as compared to the radially outermost inserts of conventional hammer bit having radial positioned between about 7.5 and 8.75 inches, the radially outermost inserts of exemplary bit 100 having radial positioned between about 7.5 and 8.75 inches offer the potential for a reduced average cutting area per insert, thereby offering the potential to enhance the durability and life of the radially outermost inserts that are typically the most susceptible to premature wear and damage. Consequently, embodiments described herein offer the potential to make the insert loading more uniform through enhanced load sharing, and reduce the peak insert loads that may be observed in more conventional hammer bit cutting structures.

It should also be appreciated that as bit 100 is indexed, the annular paths of inserts 121, 123 at least partially overlap, and thus, adjacent to gage inserts 123 provide some assistance and protection to gage inserts 121. More specifically, due to overlap between cutter elements 121, 123, the annular path of adjacent to gage cutter elements 123 at least partially overlap with the annular paths of gage inserts 121, and thus, adjacent to gage cutter elements 123 scrape and partially clear, that, in the absence of adjacent to gage cutter elements 123, would be cut entirely engaged by gage cutter elements 121. Thus, load sharing enabled by the embodiments described herein offers the potential for reduced stresses, reduced wear, reduced likelihood of premature damage to cutter elements (e.g., gage cutter elements 121), and thus, longer service life for the hammer bit (e.g., hammer bit 100).

Moreover, another potential benefit of the radial overlap between adjacent rows of inserts is the reduction in circumferential gap between adjacent inserts in contact with the formation. Without being limited by this or any particular theory, a reduction in gap tends to reduce the torque required for drilling. Higher drilling torques typically increase the loads induced in scraping, which may be detrimental to the insert life and thereby overall bit durability.

The beneficial load sharing of the embodiments described herein is achieved without necessitating a reduction in the size of slots or scallops 175 in skirt surface 170. Although the concept of overlapping and load sharing between cutter elements in adjacent rows has been described primarily with regard to gage cutter elements 121 and adjacent to gage cutter elements 123, it may also be applied to other adjacent rows of cutter elements. For instance, the adjacent to gage cutter elements (e.g., adjacent to gage cutter elements 123) may partially overlap with an adjacent row of inner row inserts (e.g., inner row inserts 131) to allow load sharing between the adjacent to gage inserts and the inner row inserts. Such load sharing among adjacent rows radially inward of the gage row may be particularly suited to larger bits where adjacent to gage row inserts and some radially outer inner row inserts experience substantial radial velocities and travel distances.

Depending on a variety of factors including, without limitation, formation type, formation hardness, and composition of the inserts (e.g., inserts 121, 123), mechanical properties of the inserts, or combinations thereof, the degree of overlap and load sharing between adjacent cutter elements in rotated profile view may be varied. In general, the degree of load sharing desired determines the amount or degree of overlap, where less overlap equates to less load sharing, and vice versa.

Figure 10:
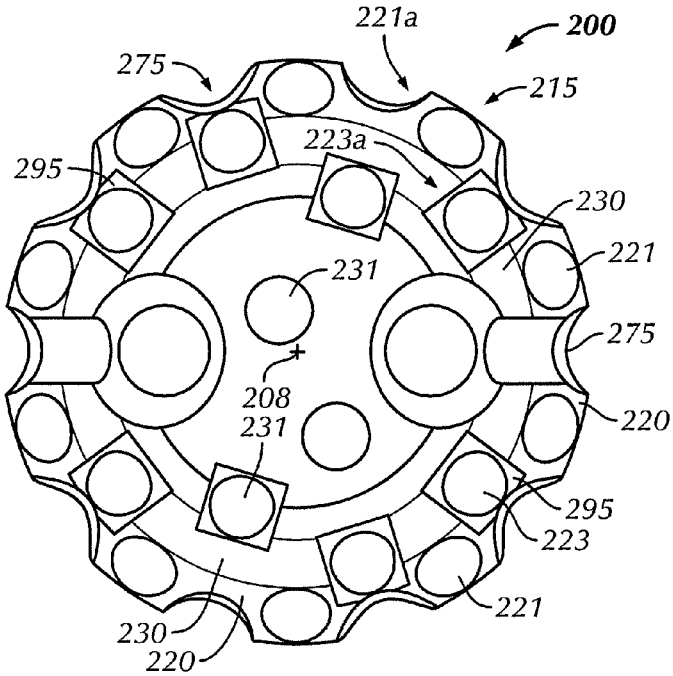
FIG. 10 is a bottom view of an embodiment of a hammer bit made in accordance with the principles described herein.

Referring now to FIG. 10, another embodiment of a percussion or hammer bit 200 that may be employed in percussion drilling assembly 10 previously described is shown. Bit 200 is similar to bit 100 previously described. Namely, bit 200 has a central longitudinal axis 208 and comprises a formation engaging bit face 210 that supports a cutting structure 215. Bit face 210 includes a radially outermost annular gage surface 220 and an annular first inner surface 230 radially adjacent to gage surface 220. A plurality of wear resistant inserts or cutter elements disposed about face 210 and arranged in circumferential rows. In particular, bit 200 includes a radially outermost circumferential gage row 221*a* of gage cutter elements or inserts 221 secured to gage surface 220. Radially adjacent to gage row 221*a*, bit 200 includes a second circumferential row 223*a* of adjacent to gage cutter elements or inserts 223, and radially inward of row 223*a*, bit 200 includes a plurality of inner row cutter elements or inserts 231. However, in this embodiment, adjacent to gage cutter elements 223 are not secured to the gage surface 220. In particular, due to the size or diameter of the bit, the radial width of gage surface 220, the location and size of pressurized fluid flow slots or scallops 275, and the diameter of cutter elements 221, 223, there is insufficient space available on gage surface 220 for gage inserts 221 and adjacent to gage inserts 223. In addition, in this embodiment, there is insufficient radial space to position adjacent to gage insets 223 on first inner surface 230. To enable radial overlap between gage inserts 221 and adjacent to gage inserts 223, as well as radial overlap between adjacent to gage inserts 223 and the radially adjacent inner row inserts 231, in rotated profile, a plurality of flats 295 are formed on bit face 210. In particular, flats 295 are circumferentially spaced and disposed at substantially the same radial position. Each adjacent to gage inserts 223 is disposed on one of the flats 295. Each flat 295 extends from first inner surface 230 at least partially across gage surface 220, thereby enabling adjacent to gage inserts 223 to be moved radially outward sufficiently to overlap with gage inserts 221 in rotated profile view. In general, flats 295 may be cast as part of the bit body, machined, or formed by any other suitable method.

Figure 11:
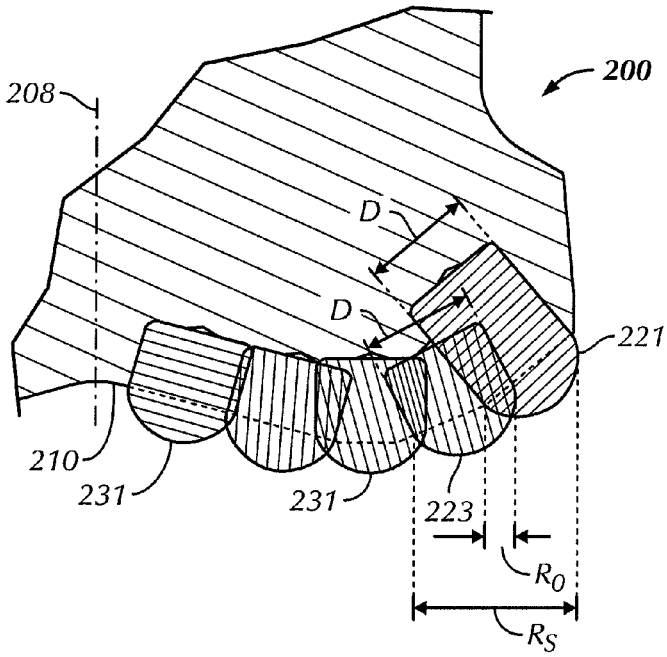
FIG. 11 is a partial cross-sectional view of the hammer bit of FIG. 10 with the cutting face and cutter elements rotated into a single profile.

Referring now to FIG. 11, an exemplary profile of hammer bit 200 is shown as it would appear with cutting face 210 and all cutter elements 221, 223, 231 rotated into a single profile, commonly referred to as a rotated profile view.

In rotated profile view, cutter elements 221, 223, 231 form a combined or composite bottomhole cutting profile 290 that spans substantially the entire borehole bottom. In addition, gage inserts 221 and adjacent to gage inserts 223 are positioned on bit face 210 such that the profiles of inserts 221, 223 radially overlap. Radially overlapping inserts 221, 223 have a diameter D, and define a radial span distance $R_s$ and a radial overlap distance $R_o$. As previously described, the ratio of the radial overlap distance $R_o$ to the radial span distance $R_s$ (i.e., the radial overlap ratio) is preferably between 0.10 and 0.50, and more preferably between 0.25 and 0.40. For an exemplary 6.5 in. hammer bit 200 with inserts 221, 223 having diameter D of 0.75 in., the radial span distance $R_s$ of inserts 221, 223 measured perpendicular to bit axis 208 is about 1.08 in., and the radial overlap distance of inserts 221, 223 measured perpendicular to bit axis 208 is about 0.22 in. Thus, the radial overlap ratio is about 0.21.

In addition, the ratio of the radial overlap distance $R_o$ to the insert diameter D is preferably between 0.20 and 0.60, and more preferably between 0.25 and 0.40. For the exemplary 6.5 in. hammer bit 200 with inserts 221, 223 having diameters D of 0.75 in., the radial overlap distance Do is about 0.22 in. Thus, the ratio of the overlap distance Do to the diameter D is about 0.30.

Figure 12:
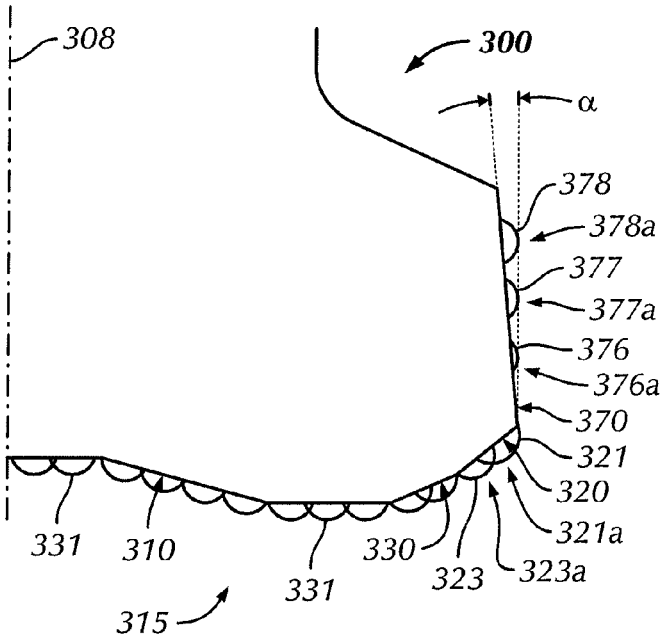
FIG. 12 is a partial cross-sectional view of an embodiment of a hammer bit made in accordance with the principles described herein, with the cutting face and cutter elements rotated into a single profile.

Referring now to FIG. 12, the rotated profile view of another embodiment of a percussion or hammer bit 300 that may be employed in assembly 10 previously described is shown. Bit 300 is similar to bit 100 previously described. Namely, bit 300 has a central longitudinal axis 308 and comprises a formation engaging bit face 310 that supports a cutting structure 315 and a skirt surface 370 extending upward from the outer periphery of bit face 310. In this embodiment, skirt surface 37 is generally frustoconical and is oriented at an angle $\alpha$ relative to the generally cylindrical borehole sidewall In other embodiments, the skirt surface (e.g., skirt surface 370) may be cylindrical and substantially parallel to the borehole sidewall (i.e., angle $\alpha$ is zero).

Bit face 310 includes a radially outermost annular gage surface 320 and an annular first inner surface 330 radially adjacent to gage surface 320. A plurality of wear resistant inserts or cutter elements disposed about face 110 and arranged in circumferential rows. In particular, bit 300 includes a radially outermost circumferential gage row 321*a* of gage cutter elements or inserts 321, a second circumferential row 323*a* of adjacent to gage cutter elements or inserts 323, and a plurality of inner row cutter elements or inserts 331 arranged in circumferential rows. In this embodiment, gage cutter elements 321 radially overlap with adjacent to gage cutter elements 323 in rotated profile view, thereby offering the potential for load sharing between cutter elements 321, 323, and enhanced cutter element and bit durability.

Moreover, in this embodiment, bit 300 further includes a plurality of axially spaced circumferential rows of gage protection cutter elements or inserts extending from skirt surface 370. More specifically, bit 300 comprises a first circumferential row 376*a* of gage protection cutter elements 376, a second circumferential row 377*a* of gage protection cutter elements 377 axially spaced above first row 376*a*, and a third circumferential row 378*a* of gage protection cutter elements 378 axially spaced above second row 377*a*.

Figure 13:
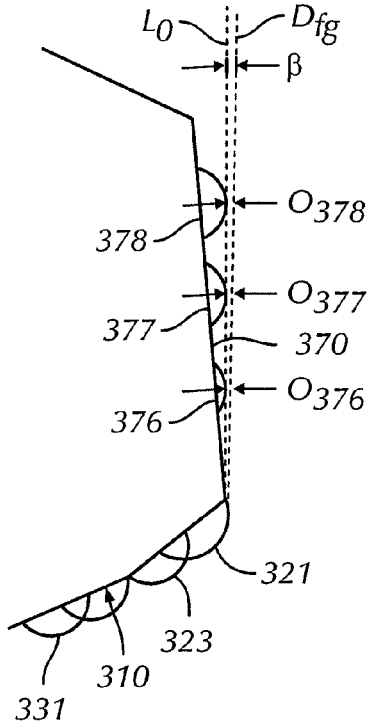
FIG. 13 is an enlarged partial cross-section view of the rotated profile of FIG. 12.

Referring now to FIG. 13, in this embodiment, gage protection cutter elements 376, 377, 378 are offset from the full gage diameter $D_{fg}$ defined by the radially outermost surface gage cutter elements 321—gage protection cutter elements 376, 377, 378 are offset from full gage diameter $D_{fg}$ by an offset distance $O_{376}$, $O_{377}$, $O_{378}$ measured perpendicular to skirt surface 370. In this embodiment, moving axially upward from the outer periphery of bit face 310, gage protection cutter elements 376, 377, 378 are increasingly offset from full gage diameter $D_{fg}$. Thus, offset distance $O_{378}$ is greater than offset distance $O_{377}$, and offset distance $O_{377}$ is greater than offset distance $O_{376}$. Further, in this embodiment, an angular offset line $L_o$ connecting the radially outermost tips of gage protection cutter elements 376, 377, 378 is oriented at an offset angle β relative to the full gage diameter $D_{fg}$. Offset angle β is preferably between 0° and 10°, and more preferably between 0° and 5°. In this embodiment, offset angle β is about 5°.

Gage protection cutter elements 376, 377, 378 generally function to share borehole sidewall cutting duty with gage cutter elements 321, thereby offering the potential to reduce wear to gage cutter elements 321, improve the durability of gage cutter elements 321, and enhance the operational life of bit 300. In particular, as the radially outer surface of gage cutter elements 321 sufficiently wears, gage protection cutter elements 376 begin to engage the borehole sidewall. Once gage protection cutter elements 376 engage the borehole sidewall, they take on a portion of the borehole sidewall cutting duty. Thus, the sidewall cutting duty is shared by gage protection cutter elements 376 and gage cutter elements 321. As a result, gage protection cutter elements 376 reduce sidewall cutting loads and associated wear experienced by gage cutter elements 321, thereby offering the potential to maintain a greater borehole diameter for longer drilling durations as compared to a hammer bit that relies solely on the gage cutter elements for borehole sidewall cutting and maintenance of the borehole diameter. In addition, upon sufficient radial wear to gage cutter elements 321 and gage protection cutter elements 376, the second set of gage protection cutter elements 377 begin to engage the borehole sidewall. Once gage protection cutter elements 377 engage the borehole sidewall, the sidewall cutting duty is shared by gage protection cutter elements 376, gage protection cutter elements 377, and gage cutter elements 321. As a result, gage protection cutter elements 377 reduce sidewall cutting loads and associated wear experienced by gage protection cutter elements 376 and gage cutter elements 321, thereby offering the potential to maintain a greater borehole diameter for longer drilling durations. Still further, upon sufficient radial wear to gage cutter elements 321 and gage protection cutter elements 376, 377, the third set of gage protection cutter elements 378 begin to engage the borehole sidewall. Once gage protection cutter elements 378 engage the borehole sidewall, the sidewall cutting duty is shared by gage protection cutter elements 376, 377 and gage cutter elements 321. As a result, gage protection cutter elements 378 reduce sidewall cutting loads and associated wear experienced by gage protection cutter elements 376, 377 and gage cutter elements 321, thereby offering the potential to maintain a greater borehole diameter for longer drilling durations.

While various preferred embodiments have been showed and described, modifications thereof can be made by one skilled in the art without departing from the spirit and teachings herein. The embodiments herein are exemplary only, and are not limiting. Many variations and modifications of the apparatus disclosed herein are possible and within the scope of the invention. Accordingly, the scope of protection is not limited by the description set out above, but is only limited by the claims which follow, that scope including all equivalents of the subject matter of the claims

What is claimed is:

1. An air-cooled hammer bit for drilling a borehole in earthen formations, the bit comprising:

a bit body having a bit axis and a bit face with an outermost radius, wherein the bit face includes an inner region extending from the bit axis to about 50% of the bit radius and an outer region extending from the inner region to the outermost radius;

a plurality of gage cutter elements mounted to the bit face in a circumferential gage row in the outer region, wherein the circumferential gage row extends around the bit axis and wherein each gage cutter element in the gage row is disposed at the same radial position relative to the bit axis;

a plurality of adjacent to gage cutter elements mounted to the bit face in a circumferential adjacent to gage row in the outer region, wherein the circumferential adjacent to gage row extends around the bit axis and wherein each adjacent to gage cutter element is disposed at the same radial position relative to the bit axis; and a plurality of inner row cutter elements mounted in a plurality of circumferential rows in the inner region and the outer region, wherein each circumferential row of inner row cutter elements extends around the bit axis and wherein each inner row cutter element is radially positioned between the bit axis and the adjacent to gage cutter elements;

wherein each cutter element has a cutting portion extending from the bit face, the cutting portion defining a cutting profile in rotated profile view;

wherein the cutting profile of at least one gage cutter element in the gage row in the outer region radially overlaps with the cutting profile of at least one adjacent to gage cutter element in the adjacent to gage row in rotated profile view, wherein the cutting profile of each cutter element in the outer region radially overlaps with the cutting profile of at least one other cutter element in a different row;

wherein a radial distance between an inner radius of the cutting profile of each gage cutter element and an outer radius of the cutting profile of each adjacent to gage cutter element defines a radial overlap distance, and wherein each gage cutter element and each adjacent to gage cutter element has a diameter, wherein the ratio of the radial overlap distance to the diameter of the gage cutter element is between 0.10 and 0.60;

wherein the cutting portion of each gage cutter element extends radially from an inner radius measured perpendicularly from the bit axis to an outer radius measured perpendicularly from the bit axis, wherein the cutting portion of each adjacent to gage cutter element extends radially from an inner radius measured perpendicularly from the bit axis to an outer radius measured perpendicularly from the bit axis;

wherein the inner radius of the cutting portion of each gage cutter element is less than the outer radius of the cutting portion of each adjacent to gage cutter element;

wherein the radial distance between the inner radius of the cutting profile of each adjacent to gage cutter element and the outer radius of the cutting profile of each gage cutter element defines a radial span distance; and wherein the ratio of the radial overlap distance to the radial span distance is between 0.10 and 0.50.

2. The hammer bit of claim 1 wherein the cutting profiles of a majority of cutter elements in each row in the outer region radially overlap with the cutting profile of at least one other cutter element in a different row.

3. The hammer bit of claim 1, wherein the ratio of the radial overlap distance to the radial span distance is between 0.25 and 0.45.

4. The hammer bit of claim 1, wherein each gage cutter element and adjacent to gage cutter element has a central axis, the central axes of the gage cutter elements and the adjacent to gage cutter elements being substantially parallel in rotated profile view.

5. The hammer bit of claim 1 wherein the ratio of the overlap distance to the diameter of the gage cutter elements is between 0.25 and 0.55.

6. The hammer bit of claim 1, wherein the bit face comprises a radially outermost annular gage surface, and wherein each gage cutter element and each adjacent to gage cutter element is completely radially disposed within the annular gage surface.

7. The hammer bit of claim 1, wherein the bit face comprises a radially outermost annular gage surface and a plurality of circumferentially spaced flats arranged in a circumferential row, wherein the flats extend partially across the annular gage surface, and wherein each gage cutter element is completely radially disposed within the annular gage surface and each adjacent to gage cutter elements is completely disposed within one of the flats.

8. The hammer bit of claim 1, further comprising a skirt surface extending from the periphery of the bit face and a first plurality of gage protection cutter elements extending from the skirt surface, wherein the first plurality of gage protection cutter elements are arranged in a first circumferential row.

9. The hammer bit of claim 8 further comprising a second plurality of gage protection cutter elements extending from the skirt surface, wherein the second plurality of gage protection cutter elements are arranged in a second circumferential row axially spaced from the first circumferential row.

10. The hammer bit of claim 9 wherein the radially outermost surface of the gage cutter elements defines a full gage diameter, wherein the first plurality of gage protection cutter elements are radially offset from the full gage diameter by a first offset distance, and wherein the second plurality of gage protection cutter elements are radially offset from the full gage diameter by a second offset distance that is greater than the first offset distance.

11. The hammer bit of claim 10 wherein the second plurality of gage protection cutter elements are axially disposed above the first plurality of gage protection cutter elements.

12. The hammer bit of claim 10 further comprising a third plurality of gage protection cutter elements extending from the skirt surface, wherein the third plurality of gage protection cutter elements are arranged in a third circumferential row axially spaced from the first circumferential row and the second circumferential row of gage protection cutter elements.

13. The hammer bit of claim 12 wherein the third plurality of gage protection cutter elements are radially offset from the full gage diameter by a third offset distance that is greater than the second offset distance.

14. The hammer bit of claim 1, wherein each cutter element in the outer region is a PCD insert.

15. The hammer bit of claim 1, wherein at least one of the plurality of gage cutter elements and at least one of the plurality of adjacent to gage cutter elements have substantially the same diameter.

16. An air-cooled percussion drilling assembly for drilling a borehole in an earthen formation comprising:

a case;

a top sub coupled to the upper end of the case;

a driver sub coupled to the lower end of the case;

a piston disposed within the case;

a hammer bit slidingly received by the driver sub;

wherein the hammer bit includes:

a bit body having a bit axis and a bit face with an outermost radius;

a plurality of gage cutter elements mounted to the bit face in a circumferential gage row in the outer region, wherein the circumferential gage row extends around the bit axis and wherein each gage cutter element is disposed at the same radial position relative to the bit axis;

a plurality of adjacent to gage cutter elements mounted to the bit face in a circumferential row in the outer region that is radially adjacent the gage row, wherein the circumferential adjacent to gage row extends around the bit axis and wherein each adjacent to gage cutter element is disposed the same radial position relative to the bit axis;

wherein each cutter element has a cutting portion extending from the bit face, the cutting portion defining a cutting profile in rotated profile view;

wherein the cutting profile of each gage cutter element extends radially from an inner radius measured perpendicularly from the bit axis to an outer radius measured perpendicularly from the bit axis, wherein the cutting profile of each adjacent to gage cutter element extends radially from an inner radius measured perpendicularly from the bit axis to an outer radius measured perpendicularly from the bit axis, and wherein the inner radius of the cutting profile of each gage cutter element is less than the outer radius of the cutting profile of each adjacent to gage cutter element;

wherein the radial distance between the inner radius of the cutting profile of each adjacent to gage cutter element and the outer radius of the cutting profile of each gage cutter element defines a radial span distance, and the radial distance between the inner radius of the cutting profile of each gage cutter element and the outer radius of the cutting profile of each adjacent to gage cutter element defines a radial overlap distance; and wherein the ratio of the radial overlap distance to the radial span distance is between 0.10 and 0.50.

17. The hammer bit of claim 16 wherein the ratio of the radial overlap distance to the radial span distance is between 0.25 and 0.45.

18. The hammer bit of claim 16 wherein each gage cutter element and each adjacent to gage cutter elements has a diameter, and wherein the ratio of the radial overlap distance to the diameter of the gage cutter elements is between 0.10 and 0.60.

19. The hammer bit of claim 16 wherein each gage cutter element and adjacent to gage cutter element has a central axis, the central axes of the gage cutter elements and the adjacent to gage cutter elements being substantially parallel in rotated profile view.

20. The hammer bit of claim of claim 16 further comprising:

a skirt surface extending from the periphery of the bit face;

a first plurality of gage protection cutter elements extending from the skirt surface, wherein the first plurality of gage cutter elements are arranged in a first circumferential row; and a second plurality of gage protection cutter elements extending from the skirt surface, wherein the second plurality of gage protection cutter elements are arranged in a second circumferential row axially spaced above the first circumferential row.

21. The hammer bit of claim 20 wherein the radially outermost surface of the gage cutter elements defines a full gage diameter, wherein the first plurality of gage protection cutter elements are radially offset from the full gage diameter by a first offset distance, and wherein the second plurality of gage protection cutter elements are radially offset from the full gage diameter by a second offset distance that is greater than the first offset distance.

22. The hammer bit of claim 21 further comprising a third plurality of gage protection cutter elements extending from the skirt surface, wherein the third plurality of gage protection cutter elements are arranged in a third circumferential row axially spaced above the second circumferential row.

23. The hammer bit of claim 22 wherein the third plurality of gage protection cutter elements are radially offset from the full gage diameter by a third offset distance that is greater than the second offset distance.

24. An air-cooled hammer bit for drilling a borehole in earthen formations, the bit comprising:

a bit body having a bit axis and a bit face with an outermost radius;

a plurality of gage cutter elements mounted to the bit face in a circumferential gage row, wherein the circumferential gage row extends around the bit axis and wherein each gage cutter element is disposed at the same radial position relative to the bit axis;

a plurality of adjacent to gage cutter elements mounted to the bit face in a circumferential row that is radially adjacent the gage row, wherein the circumferential adjacent to gage row extends around the bit axis and wherein each adjacent to gage cutter element is disposed at the same radial position relative to the bit axis;

a first plurality of inner row cutter elements mounted in a first inner row that is radially adjacent the adjacent to gage row, wherein the first inner row extends around the bit axis and wherein each of the first plurality of inner row cutter elements is disposed at the same radial position relative to the bit axis; and a second plurality of inner row cutter elements mounted in a second inner row that is radially adjacent the first inner row, wherein the second inner row extends around the bit axis and wherein each of the second plurality of inner row cutter elements is disposed at the same radial position relative to the bit axis;

wherein each cutter element has a cutting portion extending from the bit face, the cutting portion defining a cutting profile in rotated profile view;

wherein the cutting profile of each gage cutter element radially overlaps with the cutting profile of each adjacent to gage cutter element in rotated profile view;

wherein the cutting profile of each gage cutter element extends radially from an inner radius measured perpendicularly from the bit axis to an outer radius measured perpendicularly from the bit axis, wherein the cutting profile of each adjacent to gage cutter element extends radially from an inner radius measured perpendicularly from the bit axis to an outer radius measured perpendicularly from the bit axis, wherein a radial distance between the inner radius of the cutting profile of each adjacent to gage cutter element and the outer radius of the cutting profile of each gage cutter element defines a radial span distance, and a radial distance between the inner radius of the cutting profile of each gage cutter element and the outer radius of the cutting profile of each adjacent to gage cutter element defines a radial overlap distance, and wherein the ratio of the radial overlap distance to the radial span distance is between 0.10 and 0.50.

25. The hammer bit of claim 24 wherein each gage cutter element and adjacent to gage cutter element has a central axis, the central axes of the gage cutter elements and the adjacent to gage cutter elements being substantially parallel in rotated profile view.

26. The hammer bit of claim 24 wherein each gage cutter element and each adjacent to gage cutter elements has a diameter, and wherein the ratio of the radial overlap distance to the diameter of the gage cutter elements is between 0.20 and 0.60.

27. The hammer bit of claim of claim 24 further comprising a skirt surface extending from the periphery of the bit face and a first plurality of gage protection cutter elements extending from the skirt surface, wherein the first plurality of gage cutter elements are arranged in a first circumferential row.

28. The hammer bit of claim 27 further comprising a second plurality of gage protection cutter elements extending from the skirt surface, wherein the second plurality of gage protection cutter elements are arranged in a second circumferential row axially spaced from the first circumferential row.

29. The hammer bit of claim 28 wherein the radially outermost surface of the gage cutter elements defines a full gage diameter, wherein the first plurality of gage protection cutter elements are radially offset from the full gage diameter by a first offset distance, and wherein the second plurality of gage protection cutter elements are radially offset from the full gage diameter by a second offset distance that is greater than the first offset distance.

30. The hammer bit of claim 29 further comprising a third plurality of gage protection cutter elements extending from the skirt surface, wherein the third plurality of gage protection cutter elements are arranged in a third circumferential row axially spaced from the first circumferential row and the second circumferential row of gage protection cutter elements.

31. The hammer bit of claim 30 wherein the third plurality of gage protection cutter elements are radially offset from the full gage diameter by a third offset distance that is greater than the second offset distance.

32. The hammer bit of claim 24, wherein the cutting profile of each adjacent to gage cutter element radially overlaps with the cutting profile of each of the first plurality of inner row cutter elements in rotated profile view;

wherein the cutting profile of each of the first plurality of inner row cutter elements radially overlaps with the cutting profile of each of the second plurality of inner row cutter elements in rotated profile view, and wherein each of the gage cutter elements, adjacent to gage cutter elements, first plurality of inner row cutter elements, and second plurality of inner row cutter elements is a PCD cutter element.

33. An air-cooled hammer bit for drilling a borehole in earthen formations, the bit comprising:

a bit body having a bit axis and a bit face;

a plurality of gage cutter elements mounted to the bit face in a circumferential gage row, wherein the circumferential gage row extends around the bit axis and wherein each gage cutter element is disposed at the same radial position relative to the bit axis; and a plurality of adjacent to gage cutter elements mounted to the bit face in a circumferential row that is radially adjacent the gage row, each adjacent to gage cutter element having substantially the same radial position relative to the bit axis;

wherein the radially outermost surface of the gage cutter elements defines a full gage diameter, wherein each cutter element has a cutting portion extending from the bit face, the cutting portion defining a cutting profile in rotated profile view, wherein a radial distance between an inner radius of the cutting profile of each gage cutter element and an outer radius of the cutting profile of each adjacent to gage cutter element defines a radial overlap distance, wherein each gage cutter element and each adjacent to gage cutter elements has a diameter, and wherein the ratio of the radial overlap distance to the diameter of the gage cutter elements is at least 0.40;

wherein the cutting profile of each gage cutter element radially overlaps with the cutting profile of each adjacent to gage cutter element in rotated profile view;

wherein the cutting profile of each a gage cutter elements extends radially from an inner radius measured perpendicularly from the bit axis to an outer radius measured perpendicularly from the bit axis, wherein the cutting profile of each adjacent to gage cutter elements extends radially from an inner radius measured perpendicularly from the bit axis to an outer radius measured perpendicularly from the bit axis, and wherein the inner radius of the cutting profile of each gage cutter element is less than the outer radius of the cutting profile of each adjacent to gage cutter element; and wherein the radial distance between the inner radius of the cutting profile of each adjacent to gage cutter element and the outer radius of the cutting profile of each gage cutter element defines a radial span distance, and wherein the ratio of the radial overlap distance to the radial span distance is between 0.10 and 0.50.

34. The hammer bit of claim 33, further comprising:

a skirt surface extending from the periphery of the bit face, wherein the skirt surface is generally frustoconical and tapered toward the bit axis moving axially upward from the bit face;

a first plurality of gage protection cutter elements extending from the skirt surface, wherein the first plurality of gage protection cutter elements are arranged in a first circumferential row; and a second plurality of gage protection cutter elements extending from the skirt surface, wherein the second plurality of gage protection cutter elements are arranged in a second circumferential row axially spaced from the first circumferential row, wherein the first plurality of gage protection cutter elements are radially offset from the full gage diameter by a first offset distance, and wherein the second plurality of gage protection cutter elements are radially offset from the full gage diameter by a second offset distance that is greater than the first offset distance.

35. The hammer bit of claim 34 wherein the second plurality of cutter elements are axially disposed above the first plurality of cutter elements.

36. The hammer bit of claim 34 further comprising a third plurality of gage protection cutter elements extending from the skirt surface, wherein the third plurality of gage protection cutter elements are arranged in a third circumferential row axially spaced from the first circumferential row and the second circumferential row.

37. The hammer bit of claim 36 wherein the third plurality of gage protection cutter elements are radially offset from the full gage diameter by a third offset distance that is greater than the second offset distance.

38. The hammer bit of claim 37 wherein the third plurality of cutter elements are axially disposed above the first and the second plurality of cutter elements.

39. The hammer bit of claim 33, wherein the ratio of the radial overlap distance to the diameter of the gage cutter elements is between 0.40 and 0.60.

40. An air-cooled hammer bit for drilling a borehole in earthen formations, the bit comprising:

a bit body having a bit axis and a bit face, wherein the bit face includes a radially outermost frustoconical gage surface;

a plurality of gage cutter elements extending from the gage surface, wherein the gage cutter elements are arranged in a circumferential gage row extending around the bit axis, and wherein each gage cutter element is disposed at the same radial position relative to the bit axis;

a plurality of adjacent to gage cutter elements extending from the gage surface, wherein each adjacent to gage cutter element has substantially the same radial position relative to the bit axis and is positioned radially inward of each gage cutter element relative to the bit axis;

wherein each cutter element has a cutting portion extending from the bit face, the cutting portion defining a cutting profile in rotated profile view;

wherein the cutting profile of each gage cutter element radially overlaps with the cutting profile of each adjacent to gage cutter element in rotated profile view;

wherein the cutting profile of each gage cutter element extends radially from an inner radius measured perpendicularly from the bit axis to an outer radius measured perpendicularly from the bit axis, wherein the cutting profile of each adjacent to gage cutter element extends radially from an inner radius measured perpendicularly from the bit axis to an outer radius measured perpendicularly from the bit axis, and wherein the inner radius of the cutting profile of each gage cutter element is less than the outer radius of the cutting profile of each adjacent to gage cutter element;

wherein the radial distance between the inner radius of the cutting profile of each adjacent to gage cutter element and the outer radius of the cutting profile of each gage cutter element defines a radial span distance, and the radial distance between the inner radius of the cutting profile of each gage cutter element and the outer radius of the cutting profile of each adjacent to gage cutter element defines a radial overlap distance;

wherein the ratio of the radial overlap distance to the radial span distance is at least 0.40;

wherein the cutting profile of each gage cutter extends radially from an inner radius measured perpendicularly from the bit axis to an outer radius measured perpendicularly from the bit axis, wherein the cutting profile of each adjacent to gage cutter element extends radially from an inner radius measured perpendicularly from the bit axis to an outer radius measured perpendicularly from the bit axis;

wherein the radial distance between the inner radius of the cutting profile of each adjacent to gage cutter element and the outer radius of the cutting profile of each gage cutter element defines a radial span distance, and the radial distance between the inner radius of the cutting profile of each gage cutter element and the outer radius of the cutting profile of each adjacent to gage cutter element defines a radial overlap distance; and wherein the ratio of the radial overlap distance to the radial span distance is between 0.40 and 0.50.

41. The hammer bit of claim 40, wherein the ratio of the radial overlap distance to the radial span distance is between 0.40 and 0.45.

42. The hammer bit of claim 40 wherein each gage cutter element and adjacent to gage cutter element has a central axis, the central axes of the gage cutter elements and the adjacent to gage cutter elements being substantially parallel in rotated profile view.

43. The hammer bit of claim 40, wherein each gage cutter element and each adjacent to gage cutter elements has a diameter, and wherein the ratio of the radial overlap distance to the diameter of the gage cutter elements is between 0.10 and 0.60.

44. The hammer bit of claim of claim 40 further comprising a skirt surface extending from the gage surface of the bit face and a first plurality of gage protection cutter elements extending from the skirt surface, wherein the first plurality of gage cutter elements are arranged in a first circumferential row.

45. The hammer bit of claim 44 further comprising a second plurality of gage protection cutter elements extending from the skirt surface, wherein the second plurality of gage protection cutter elements are arranged in a second circumferential row axially spaced from the first circumferential row.

46. The hammer bit of claim 45 wherein the radially outermost surface of the gage cutter elements defines a full gage diameter, wherein the first plurality of gage protection cutter elements are radially offset from the full gage diameter by a first offset distance, and wherein the second plurality of gage protection cutter elements are radially offset from the full gage diameter by a second offset distance that is greater than the first offset distance.

* * * * *